US012270629B2

(12) United States Patent
Rubinraut et al.

(10) Patent No.: US 12,270,629 B2
(45) Date of Patent: Apr. 8, 2025

(54) METHOD AND SYSTEM FOR HOMING

(71) Applicant: C.2.V Line Ltd, Tel-Aviv (IL)

(72) Inventors: Ephraim (Francois Henri) Rubinraut, Tel-Aviv (IL); Aron Szapiro, Yehud-Monosson (IL)

(73) Assignee: C.2.V Line Ltd, Tel-Aviv (IL)

( * ) Notice: Subject to any disclaimer, the term of this patent is extended or adjusted under 35 U.S.C. 154(b) by 129 days.

(21) Appl. No.: 18/026,145

(22) PCT Filed: Sep. 14, 2021

(86) PCT No.: PCT/IL2021/051123

§ 371 (c)(1),
(2) Date: Mar. 14, 2023

(87) PCT Pub. No.: WO2022/054067

PCT Pub. Date: Mar. 17, 2022

(65) Prior Publication Data

US 2023/0358509 A1 Nov. 9, 2023

(30) Foreign Application Priority Data

Sep. 14, 2020 (IL) ..... 277347

(51) Int. Cl.
*F41G 7/22* (2006.01)

(52) U.S. Cl.
CPC ..... *F41G 7/22* (2013.01); *F41G 7/2253* (2013.01); *F41G 7/226* (2013.01)

(58) Field of Classification Search
None
See application file for complete search history.

(56) References Cited

U.S. PATENT DOCUMENTS 3,843,076 A * 10/1974 King ..... F41G 7/226 244/3.22
4,456,862 A * 6/1984 Yueh ..... G05D 1/12 244/3.17
4,494,202 A * 1/1985 Yueh ..... G05D 1/12 244/3.18
4,502,650 A * 3/1985 Yueh ..... G05D 1/12 244/3.15
5,058,024 A * 10/1991 Inselberg ..... G08G 5/0082 701/120

(Continued)

FOREIGN PATENT DOCUMENTS

EP 2807443 10/2021
WO WO 2022/054067 3/2022

OTHER PUBLICATIONS

Office Action Dated Jun. 21, 2013 From the Israel Patent Office Re. Application No. 286388. (4 Pages).

(Continued)

*Primary Examiner* — Bernarr E Gregory

(57) ABSTRACT

A method of guiding a guidable vehicle to a target comprises: acquiring at least one position vector describing a position of the target and a position of the guidable vehicle; calculating a distance between the guidable vehicle and a virtual line passing through a predicted position of the target; controlling the guidable vehicle to reduce the calculated distance; repeating the acquisition of the at least one position vector, and automatically updating the virtual line, responsively to the repeated acquisition.

20 Claims, 15 Drawing Sheets

(56) References Cited

U.S. PATENT DOCUMENTS

| | | | | |
|---|---|---|---|---|
| 6,064,332 | A * | 5/2000 | Cloutier | G05D 1/107 701/4 |
| 6,173,219 | B1 * | 1/2001 | Deker | G05D 1/0202 701/410 |
| 6,405,124 | B1 * | 6/2002 | Hutton | G08G 5/0039 701/122 |
| 7,698,026 | B2 * | 4/2010 | Dey | G08G 5/0052 701/16 |
| 7,795,565 | B2 | 9/2010 | Bock | |
| 8,116,970 | B2 * | 2/2012 | Hoofd | G08G 5/0039 701/122 |
| 9,262,933 | B2 * | 2/2016 | Hoy | G08G 5/045 |
| 9,410,807 | B2 * | 8/2016 | Savarit | G08G 5/0039 |
| 10,032,383 | B2 * | 7/2018 | Valls Hernández | G01C 21/20 |

OTHER PUBLICATIONS

Office Action Dated Jul. 28, 2024 From the Israel Patent Office Re. Application No. 286388. (4 Pages).
International Preliminary Report on Patentability Mar. 23, 2023 From the International Bureau of WIPO Re. Application No. PCT IL2021/051123. (9 Pages).
International Search Report and the Written Opinion Dated Nov. 11, 2021 From the International Searching Authority Re. Application No. PCT/IL2021/051123. (12 Pages).
Berglund "Guidance and Control Technology", National Defense Research, Defense Research Establishment, Stockholm, Sweden, Department of Defense Analysis, Presented at the RTO SCI Lecture Series on Technologies for Future Precision Strike Missile Systems, p. 3-1-3-15, Sep. 2000.
Durieux "Terminal Control for Command to Line of Sight Guided Missile", AGARD Advanced Technologies for SAM Systems Analytical Synteses and Simulation, p. 4-1-4-14, May 1984.
Fleeman et al. "Technologies for Future Precision Strike Missile Systems—Introduction/Overview", North Atlantic Treaty Organization, Research and Technology Organization, RTO-EN-018, RTO Lecture Series 221ff., p. 1-148, Jul. 2001.
Garnell et al. "Guided Weapon Control Systems", Royal Military College of Science, Shrivenham, Swindon, England, p. 1-290, 1977. (Part 1).
Garnell et al. "Guided Weapon Control Systems", Royal Military College of Science, Shrivenham, Swindon, England, p. 1-290, 1977. (Part 2).
Hofmann et al. "Missile Guidance Techniques", AGARD Guidance and Control for Tactical Weapons With Emphasis on Simulation and Testing, p. 4-1-4-27, May 1979.
Maney "Tactical Missile Performance Requirements: A Methodology for Development", AGARD, North Atlantic Treaty Organization, Advisory Group for Aerospace Research & Development, AGARD-Lecture Series No. 101: Guidance and Control for Tactical Guided Weapons With Emphasis on Simulation and Testing, p. 1-146, May 1979. (Part 1).
Maney "Tactical Missile Performance Requirements: A Methodology for Development", AGARD, North Atlantic Treaty Organization, Advisory Group for Aerospace Research & Development, AGARD-Lecture Series No. 101: Guidance and Control for Tactical Guided Weapons With Emphasis on Simulation and Testing, p. 1-146, May 1979. (Part 2).
Palumbo et al. "Modern Homing Missile Guidance Theory and Techniques", John Hopkins APL Technical Digest, 29(1): 42-59, Jan. 2010.
Pastrick et al. "Guidance Laws for Short-Range Tactical Missiles", Journal of Guidance and Control, 4(2): 98-108, Mar.-Apr. 1981.
Paulet "Advanced Technology for S.A.M. Systems: Analysis Synthesis and Simulation", AGARD, North Atlantic Treaty Organization, Advisory Group for Aerospace Research & Development, AGARD Lecture Series No. 135: Advanced Technology for SAM Systems: Analysis Synthesis and Simulation, p. 1-120, May 1984.
Shoucri "Closed-Form Solution of Line-of-Sight Trajectory for Maneuvering Target", Journal of Guidance, Control and Dynamics: Engineering Notes, 24(2): 408-409, Mar. 2001.
Yanushevsky "Modern Missile Guidance", CRC Press, Taylor & Frances Group, p. 1-242, 2008.
Zarchan "Fundamentals of Tactical Missile Guidance", Tactical and Strategic Missile Guidance, p. 40-42, 1994.
Zarchan "Tactical and Strategic Missile Guidance", Progress in Astronautics and Aeronautics, 6th Ed., 239(Chap.1-34): 1-989 & Index, Feb. 2012. (Part 1).
Zarchan "Tactical and Strategic Missile Guidance", Progress in Astronautics and Aeronautics, 6th Ed., 239(Chap.1-34): 1-989 & Index, Feb. 2012. (Part 2).
Zarchan "Tactical and Strategic Missile Guidance", Progress in Astronautics and Aeronautics, 6th Ed., 239(Chap.1-34): 1-989 & Index, Feb. 2012. (Part 3).
Office Action Dated Aug. 3, 2023 From the Israel Patent Office Re. Application No. 277347. (4 Pages).

* cited by examiner

METHOD AND SYSTEM FOR HOMING

RELATED APPLICATIONS

This application is a National Phase of PCT Patent Application No. PCT/IL2021/051123 having International filing date of Sep. 14, 2021, which claims the benefit of priority of Israel Patent Application No. 277347 filed on Sep. 14, 2020. The contents of the above applications are all incorporated by reference as if fully set forth herein in their entirety.

FIELD AND BACKGROUND OF THE INVENTION

The present invention, in some embodiments thereof, relates to guidance and, more particularly, but not exclusively, to homing based on a virtual reference.

Homing is a technique used by guided vehicles for approaching and colliding with a moving or static targetvehicle. Two types of guidance systems and their derivatives are mainly in use: Proportional Navigation (PN) and Command Line of Sight (CLOS). In PN, the guided vehicle attempts to keep a constant bearing with the target at any time. In CLOS, the guided vehicle attempts to stay on a straight line between an illuminator and the target throughout its trajectory. PN is therefore a two-point guidance law, which considers only the positions of the guided vehicle and the target, and CLOS is a three-points guidance law, which considers the positions of the illuminator, the guided vehicle and the target.

Background art describing conventional guidance technique includes, Guidance and Control Technology—Erik Berglund—Swedish Defense Research Agency—2001—RTO—EN—018, AGARD 101—Missile Guidance Techniques—Hofmann, Guided Weapon Control Systems Garnett Pergamon Press 1977, Tactical and Strategic Missile Guidance Sixth Edition—Paul Zarchan—Volume 239 Progress in Astronautics and Aeronautics, Modern Missile Guidance—Rafael Yanushevsky CRC Press 2008, Guidance Laws for Short—Range Tactical Missiles H. L. Pastrick—J. GUIDANCE AND CONTROL VOL. 4, NO. 2—AIAA 79-0059R, and AGARD 135 TERMINAL CONTROL FOR COMMAND TO LINE OF SIGFIT GUIDED MISSILE—Jean—Loup DURA UX.

SUMMARY OF THE INVENTION

Some embodiments of the invention provide a homing law for a guided vehicle to collide with a static or moving target possessing a constant or varying velocity, and/or with transverse accelerations and/or with evasive maneuvers. The homing law can be implemented on new systems or as an add-on (e.g., an upgrade) of existing systems.

The homing law of the present embodiments is advantageous since it demands less transverse accelerations and maneuvers from the guided vehicle, compared to PN or CLOS laws being applied at the same scenario.

The homing law of the present embodiments requires smaller homing ranges for the guided vehicle to collide with the target, compared to PN laws being applied at the same scenario.

In order to home the guided vehicle towards a determined target the present embodiments introduce the concepts of virtual designator, virtual line of sight and virtual collision point.

The virtual designator is the reference point for a three-point alignment law employed according to some embodiments of the present invention, where the three points optionally and preferably include the virtual designator, the guided vehicle and the target. The virtual designator is optionally and preferably at a location that, except perhaps at an initial time (e.g., launching time of the guided vehicle), is not occupied or nearby a hardware element of a homing system (e.g., a location that is not occupied or nearby an illuminator, not occupied or nearby a tracking system, and not occupied or nearby a launcher).

The virtual designator may in some embodiments of the present invention be stationary and in some embodiments of the present invention be moving along a virtual trajectory towards a virtual collision point with the target.

The virtual line of sight is a line connecting the target to the virtual designator.

For a moving virtual designator, the virtual collision point is defined as the intersection between the virtual designator trajectory and the target's trajectory.

In some embodiments of the present invention the guided vehicle is commanded to close its distance to a non-rotating virtual line connecting the virtual designator and the target at its instantaneous current position, or the virtual designator with an expected position of the target at a future time (which is optionally and preferably the final homing time).

The virtual designator of the present embodiments, the guided vehicle and the target thus form a three-point alignment according to a non-rotating virtual line.

The introduction of the virtual designator and of the no rotating virtual line concepts allows controlling the guided vehicle, taking advantage and profiting from both PN and CLOS characteristics.

Hence, according to some embodiments of the invention the present invention there is provided a method of guiding a guidable vehicle to a target. The method comprises: by a tracking system, acquiring at least one position vector describing a position of the target and a position of the guidable vehicle; calculating a distance between the guidable vehicle and a virtual line passing through the target; controlling the guidable vehicle to reduce the calculated distance; repeating the acquisition of the at least one position vector, and automatically shifting the virtual line parallel to itself, responsively to the repeated acquisition.

According to an aspect of some embodiments of the present invention there is provided a method of guiding a guidable vehicle to a target. The method comprises: by a tracking system, acquiring at least one position vector describing a position of the target and a position of the guidable vehicle; calculating a distance between the guidable vehicle and a virtual line passing through a predicted position of the target; controlling the guidable vehicle to reduce the calculated distance; repeating the acquisition of the at least one position vector, and automatically updating the virtual line, responsively to the repeated acquisition.

According to some embodiments of the invention the method comprises defining a virtual designator at a point in space, wherein the virtual line passes also through the virtual designator.

According to some embodiments of the invention the method comprises moving the virtual designator along a collision trajectory between the virtual designator and the target.

According to some embodiments of the invention an initial position of the virtual designator is at a position of the tracking system.

According to some embodiments of the invention an initial position of the virtual designator is at a position of an illuminator or a launcher.

According to some embodiments of the invention an initial position of the virtual designator is at a position other than a position of the tracking system.

According to some embodiments of the invention an initial position of the virtual designator is at a position other than a position of an illuminator or a launcher.

According to some embodiments of the invention the method comprises calculating a Zero Effort Miss (ZEM), wherein the calculation of the distance is based on the ZEM.

According to an aspect of some embodiments of the present invention there is provided a method of guiding a guidable vehicle to a target, the method comprises: acquiring at least one position vector describing a position of the target and a position of the guidable vehicle, wherein at least the position of the guidable vehicle is tracked by a tracking system; calculating a distance between the guidable vehicle and a virtual line passing through the target, but not through the tracking system; controlling the guidable vehicle to reduce the calculated distance.

According to some embodiments of the invention the target is stationary.

According to some embodiments of the invention the target is moving at a velocity having a magnitude which is less than half the magnitude of a maximal velocity of the guidable vehicle.

According to some embodiments of the invention the method comprises receiving a priori coordinates of the target and acquiring a position vector of the target based on the coordinates.

According to an aspect of some embodiments of the present invention there is provided a method of guiding a guidable vehicle to a target moving along a collision trajectory with a site, the method comprises: acquiring at least one position vector describing a position of the target, and a position of the guidable vehicle and a position of the site, wherein at least the position of the target is tracked by a tracking system positioned at a position other than the site; calculating a distance between the guidable vehicle and a virtual line passing through the target and through the site at all times; controlling the guidable vehicle to reduce the calculated distance; and repeating the acquisition of the at least one position vector, and updating the virtual line, responsively to the repeated acquisition.

According to some embodiments of the invention the site is moving at a velocity having a magnitude which is less than half the maximal magnitude of a velocity of the guidable vehicle.

According to some embodiments of the invention the method comprises operating an illuminator to illuminate the target by radiation, wherein the acquisition of the at least one position vector, is based on an echo or reflection of the radiation from the target.

According to some embodiments of the invention the acquisition is passive.

According to some embodiments of the invention the method comprises receiving data from a Global Positioning System, and acquiring a position vector of the target based, at least in part, on the data.

According to some embodiments of the invention the method comprises acquiring a position vector of the guidable vehicle based on the data.

According to some embodiments of the invention the method comprises receiving data from a Global Positioning System, and acquiring a position vector of the guidable vehicle based on the data.

According to some embodiments of the invention the method comprises receiving an input direction of impact between the guidable vehicle and the target, and defining the virtual line based on the input direction of impact.

According to some embodiments of the invention the method comprises biasing the distance between the guidable vehicle and the line, and controlling the guidable vehicle to reduce the biased distance.

According to an aspect of some embodiments of the present invention there is provided a system for guiding a guidable vehicle to a target, the system comprises: a tracking system for acquiring at least one position vector describing a position of the target and a position of the guidable vehicle; a guidance processor configured to calculate a distance between the guidable vehicle and a virtual line passing through the target; and a guidance controller configured to control the guidable vehicle to reduce the calculated distance; wherein the guidance processor is also configured to automatically shift the virtual line parallel to itself responsively to repeated acquisitions of the at least one position vector by tracking system.

According to an aspect of some embodiments of the present invention there is provided a system for guiding a guidable vehicle to a target, the system comprises: a tracking system for acquiring at least one position vector describing a position of the target and a position of the guidable vehicle; a guidance processor configured to calculate a distance between the guidable vehicle and a virtual line passing through a predicted position of the target; and a guidance controller configured to control the guidable vehicle to reduce the calculated distance; wherein the guidance processor is also configured to automatically update the virtual line responsively to repeated acquisitions of the at least one position vector by tracking system.

According to some embodiments of the invention the guidance processor is configured for defining a virtual designator at a point in space, wherein the virtual line passes also through the virtual designator.

According to some embodiments of the invention the guidance processor is configured for moving the virtual designator along a collision trajectory between the virtual designator and the target.

According to some embodiments of the invention an initial position of the virtual designator is at a position of the tracking system.

According to some embodiments of the invention an initial position of the virtual designator is at a position of an illuminator or a launcher.

According to some embodiments of the invention an initial position of the virtual designator is at a position other than a position of the tracking system.

According to some embodiments of the invention an initial position of the virtual designator is at a position other than a position of an illuminator or a launcher.

According to some embodiments of the invention the system comprises calculating a Zero Effort Miss (ZEM), wherein the calculation of the distance is based on the ZEM.

According to an aspect of some embodiments of the present invention there is provided a system for guiding a guidable vehicle to a target, the system comprises: a tracking system for acquiring at least one position vector describing a position of the target and a position of the guidable vehicle; a guidance processor configured to calculate a distance between the guidable vehicle and a virtual line passing through the target, but not through the tracking system; a guidance controller configured to control the guidable vehicle to reduce the calculated distance.

According to some embodiments of the invention the target is stationary.

According to some embodiments of the invention the target is moving at a velocity having a magnitude which is less than half the magnitude of a maximal velocity of the guidable vehicle.

According to some embodiments of the invention the guidance processor is configured for receiving a priori coordinates of the target and acquiring a position vector of the target based on the coordinates.

According to an aspect of some embodiments of the present invention there is provided a system for guiding a guidable vehicle to a target moving along a collision trajectory with a site, the system comprises: a tracking system for acquiring at least one position vector describing a position of the target and, a position of the guidable vehicle and a position of the site; a guidance processor configured to calculate a distance between the guidable vehicle and a virtual line passing through the target and through the site at all times; a guidance controller configured to control the guidable vehicle to reduce the calculated distance; wherein the guidance processor is also configured to automatically update re-align the virtual line, responsively to repeated acquisitions of the at least one position vector by tracking system.

According to some embodiments of the invention the site is stationary.

According to some embodiments of the invention the site is moving at a velocity having a magnitude which is less than half the magnitude of a maximal velocity of the guidable vehicle.

According to some embodiments of the invention the system comprises an illuminator configured to illuminate the target by radiation, wherein the acquisition of the at least one position vector, is based on an echo or reflection of the radiation from the target.

According to some embodiments of the invention the tracking system is a passive tracking system.

According to some embodiments of the invention the tracking system comprises a Global Positioning System, and is configured for acquiring a position vector of the target based, at least in part, on data obtained by the Global Positioning System.

According to some embodiments of the invention the tracking system is configured for acquiring a position vector of the guidable vehicle based on the data.

According to some embodiments of the invention the tracking system comprises a Global Positioning System, and is configured for acquiring a position vector of the guidable vehicle based on data obtained by the Global Positioning System.

According to some embodiments of the invention the guidance processor is configured for receiving an input direction of impact between the guidable vehicle and the target, and for defining the virtual line based on the input direction of impact.

According to some embodiments of the invention the guidance processor is configured for biasing the distance between the guidable vehicle and the line, and wherein the guidance controller is configured for controlling the guidable vehicle to reduce the biased distance.

According to some embodiments of the invention a position vector of the target is relative to the guidable vehicle.

According to some embodiments of the invention the tracking system is carried by the guidable vehicle.

According to some embodiments of the invention the tracking system is carried by another vehicle.

According to some embodiments of the invention the tracking system is stationary.

According to some embodiments of the invention the guidable vehicle is an aerial vehicle. According to some embodiments of the invention the guidable vehicle is a ground vehicle. According to some embodiments of the invention the guidable vehicle is an aqueous vehicle. According to some embodiments of the invention the guidable vehicle is a subaqueous vehicle. According to some embodiments of the invention the guidable vehicle is an amphibious vehicle. According to some embodiments of the invention the guidable vehicle is a semi-amphibious vehicle. According to some embodiments of the invention the guidable vehicle is a spacecraft.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented with additional sensors, chips or a circuits. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by additional sensors, a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well.

BRIEF DESCRIPTION OF SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

The present invention, in some embodiments thereof, relates to guidance and, more particularly, but not exclusively, to homing based on a virtual reference.

For purposes of better understanding some embodiments of the present invention, as illustrated in FIGS. 3-15 of the drawings, reference being first made to the construction and, operation of conventional PN and CLOS guidance techniques as illustrated in FIGS. 1A-2B, which are explained in a general way as an introduction to some embodiments of the present invention.

Figure 1A:
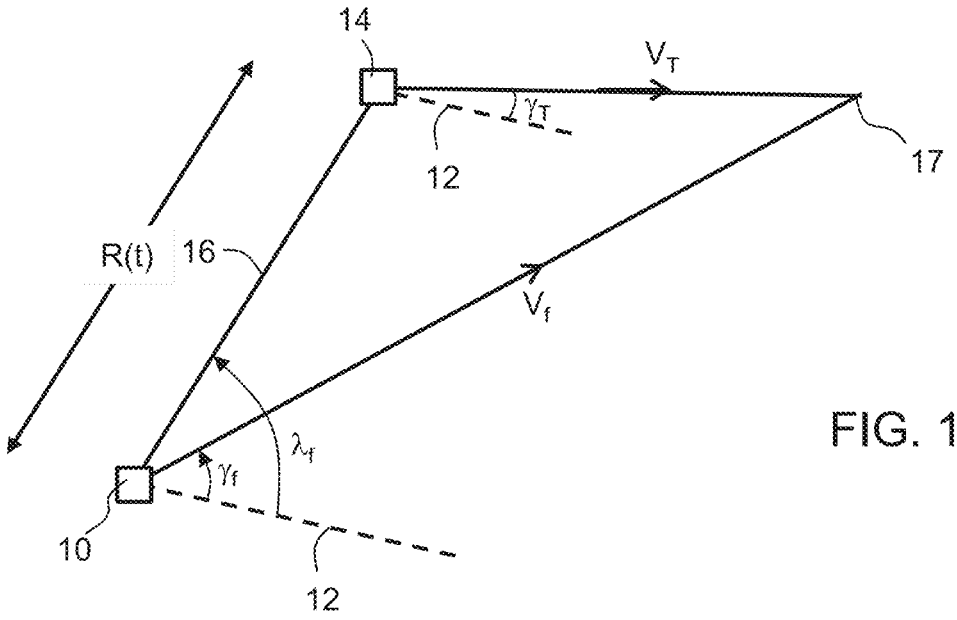
FIGS. 1A, 1B and 1C are schematic illustrations of a PN guidance technique.
Figure 1B:
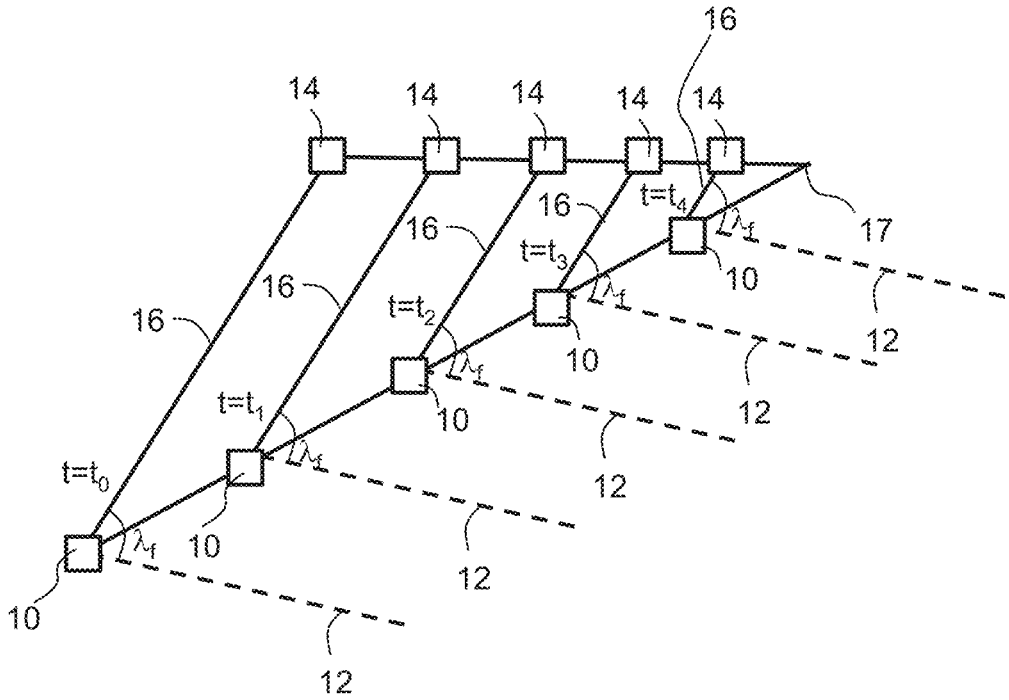
Figure 1C:
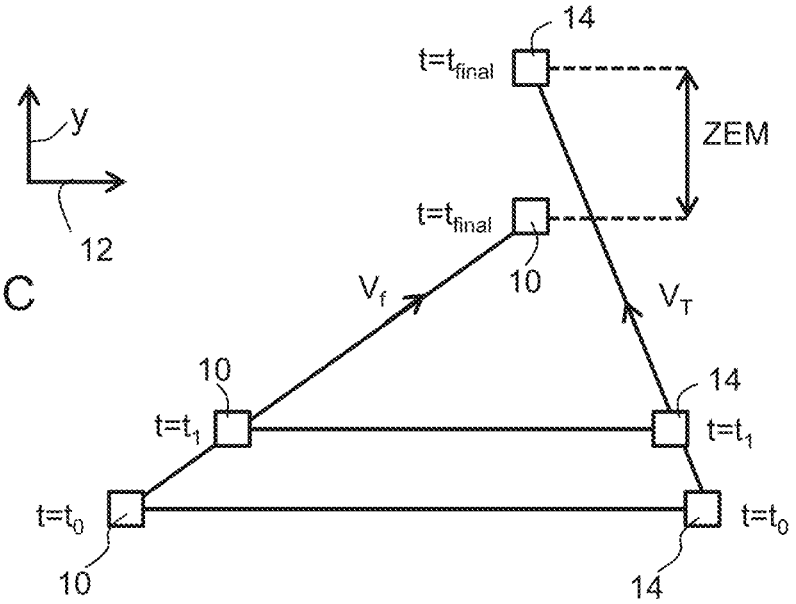

FIGS. 1A-C schematically illustrate a PN guidance technique. FIG. 1A illustrates a guided vehicle 10 moving at velocity $V_f$ forming an angle $\gamma_f$ with a reference direction 12, and a target 14 moving at velocity $V_T$ forming an angle $\gamma_T$ with the reference direction 12, such that a collision between the guided vehicle 10 and the target 14 is expected at the collision point 17. The guided vehicle-target line-of-sight 16 (namely the line-of-sight between guided vehicle 10 and target 14) forms an angle $\lambda_f$ with reference direction 12. FIG. 1A illustrates the positions and velocities at a particular time-instance.

According to the PN technique, the guided vehicle 10 is controlled to keep a constant bearing with the target 14 at any time. An ideal situation, as a function of time t, for five exemplified time points $t_0<t_1< \ldots <t_4$, is illustrated in FIG. 1B. As shown, the guidance goal is achieved when the line-of-sight 16 maintains a constant direction in space (moves parallel to itself) at each of the exemplified time points. In practice, guided vehicle 10 is continuously accelerated transversally so as to achieve the guidance goal. The law that describes the PN technique can be mathematically formulated as:

$$a_f = N \cdot C_c \cdot (d\lambda_f/dt), \qquad \text{(EQ. 1)}$$

where $a_f$ is the transverse acceleration of the guided vehicle 10, $V_c$ is the velocity of the guided vehicle 10 relative to target 14 (also known as the "closing velocity"), $d\lambda_f/dt$ is the time-derivative of the instantaneous angle $\lambda_f$ relative to reference direction 12, and N is a constant, which is typically from about 3 to about 5.

It is appreciated that EQ. 1 is a linear differential equation with time-varying coefficients. The homing process is typically a homing loop that solves this equation, where lateral accelerations ar are continuously required to approximate the situation in FIG. 1B. For PN guided vehicles, the required transversal accelerations $a_f$ is typically 3 times larger than the transversal acceleration of target 14. In practice, when the target 14 maneuvers and moves along a curved trajectory, the homing according to the PN technique is successful when the transversal acceleration capability of guided vehicle 10 is at least 3 times the maximal transverse acceleration of target 14.

The dominant time varying parameter of the homing loop is typically 1/R(t), where R(t) is the time-dependent guided vehicle-target range (the range between guided vehicle 10 and target 14, see FIG. 1A). The dependence of R(t) on t can be expressed in terms of the closing velocity, $V_c$, and the remaining motion time, tigo, which is defined as the time difference between the estimated collision time $t_{final}$ and the current time t. Formally:

$$\frac{1}{R(t)} = \frac{1}{V_C * tigo} = \frac{1}{V_C * (t_{final} - t)}. \qquad \text{(EQ. 2)}$$

Notice that $V_c$ is defined as dR(t)/dt, and so EQ. 2 approximates $V_c$ to the ratio R(t)/tigo. Ideally, the value of R(t) equals zero at $t=t_{final}$. The effective value of R(t) at $t=t_{final}$, is referred to as the "miss distance".

Inaccuracies in the guidance process may occur, e.g, due to an error in the tracking of the target 14, and due to noises introduced during the horning loop calculation. Typically, the target tracking is performed by a tracking system having a circuit configured for tracking the target and being carried by the guided vehicle 10. In this case, the main source of the tracking error in the horning loop is generally constant in the angle, so that the error in length units decreases as the guided vehicle 10 approaches target 14. The main source of noise in the horning loop is the derivative $d\lambda_f/dt$, since a numerical time-derivative is known to increase the noise levels.

The miss distance depends on the response time of the homing loop, and eventually on saturations of some parameters. In PN, the quantities that dominate the response are the value of 1/tigo, and by the characteristic time constant of the homing loop.

When commanded by PN laws, the miss distance of a guided vehicle to a target depends on the homing time. In order to achieve small miss distances the homing time should be at least 10 times the homing loop time constants. A maneuver applied to the target at 2-3 loop time constants before the planned hit will result in a maximum miss distance.

In an extension to the PN, known as the ZEM Extension, the derivative of $\lambda_f$ can be approximated as the derivative of y(t)/R(t), where y(t) is the target coordinate measured to perpendicularly to reference direction 12.

$$\dot{\lambda} \cong \frac{d}{dt}\left(\frac{y}{R}\right) = \frac{R\dot{y} - y\dot{R}}{R^2} \cong \frac{\dot{y}}{R} + \frac{y}{R \times tigo} \quad \text{(EQ. 3)}$$

where a dot above a variable (λ, y and R, in EQ. 3) represents a time-derivative. Substituting these approximations into EQ. 1, the transverse acceleration $a_f$ becomes:

$$a_f \cong N\frac{R}{tigo}\left(\frac{\dot{y}}{R} + \frac{y}{R \times tiqo}\right) \cong \frac{N}{tigo^2}(y + \dot{y} * tigo). \quad \text{(EQ. 4)}$$

The quantity (y+ẏ*tigo) is referred to as the Zero Effort Miss (ZEM) and is illustrated in FIG. 1C. For clarity of presentation, the reference direction 12 is aligned in FIG. 1C along the line-of-sight 16. The ZEM represents the expected miss distance between the target 14 and the guided vehicle 10 at the estimated interception time tfinat, in the absence of any interception maneuver by the guided vehicle 10.

The ZEM extension is typically useful for high longitudinal (along the main guided vehicle motion axis) acceleration or deceleration of guided vehicle 10, or in response to high maneuver accelerations of target 14. When the velocities $V_f$ and $V_T$ are constant, or when the maneuvers performed by target 14 are small. EQ. 4 is a cumbersome alternative to implement the PN technique.

Figure 2A:
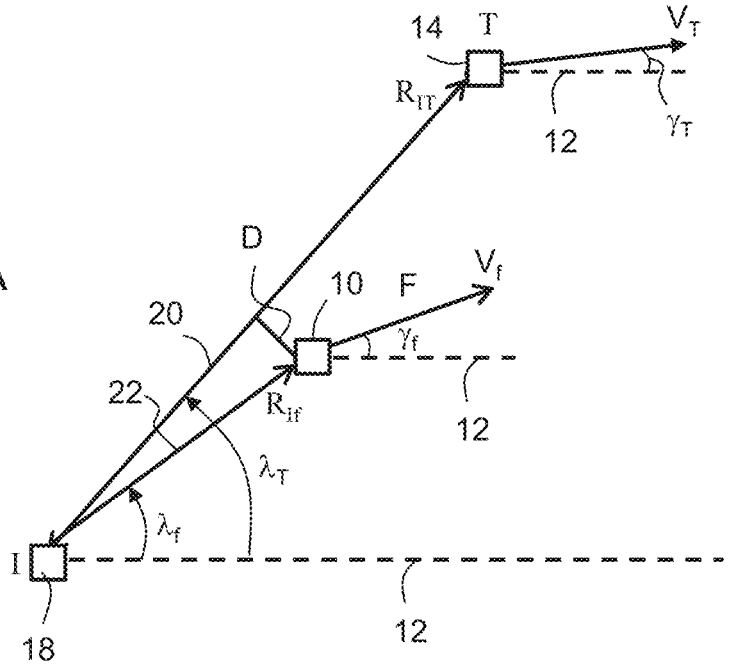
FIGS. 2A-B are schematic illustrations of a CLOS guidance technique.
Figure 2B:
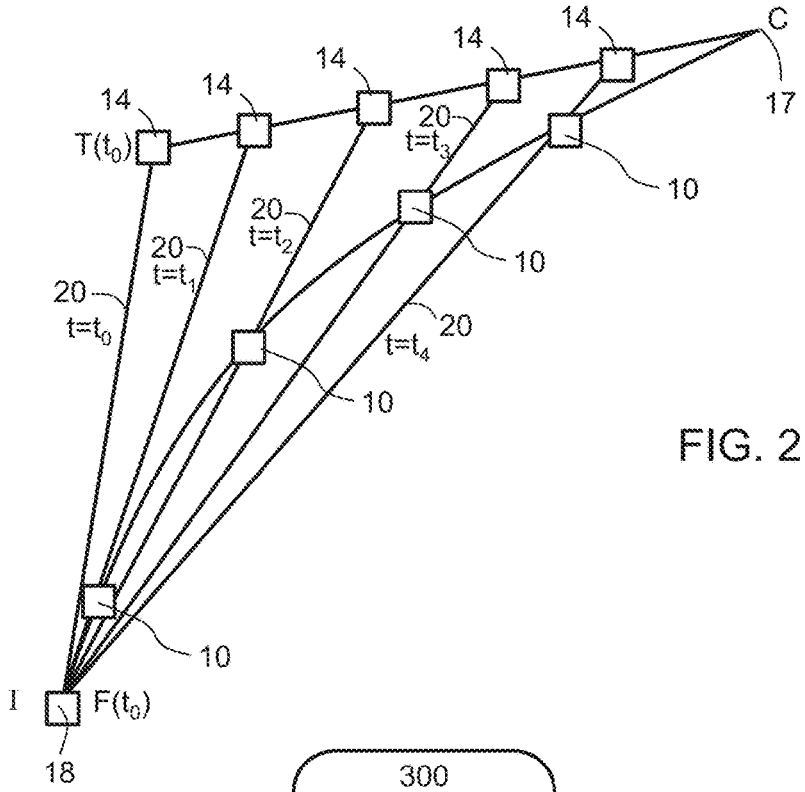

FIGS. 2A-B schematically illustrate a CLOS guidance technique. FIG. 2A illustrates the guided vehicle 10 moving at velocity $V_f$ forming angle $\gamma_f$ with reference direction 12, the target 14 moving at velocity $V_T$ forming angle $\gamma_T$ with the reference direction 12, and an illuminator 18 that illuminates target 14. The illuminator-target and illuminator-guided vehicle line-of-sights (namely the line-of-sight between illuminator 18 and target 14, and the line-of-sight between illuminator 18 and guided vehicle 10) are shown at 20, and 22, respectively.

In the CLOS homing law, a designator is oftentimes defined at one of the hardware elements of the homing system. The designator serves as a reference for defining the line-of-sight 20 to the target 14. Under the classic CLOS homing laws, the illuminator, the designator and the tracking system are generally positioned at the same geometric point, and so 18 in FIGS. 2A-B also marks the position of the designator. When the tracking is not based on active illumination (e.g., TV tracking, in which the source of illumination is typically the sun, or IR tracking which is based on thermally emitted IR radiation from the target), illuminator 18 is not employed. In the absence of active illumination, line-of-sights 20 and 22 represent the designator-target and designator-guided vehicle line-of-sights, respectively. In any event, in CLOS homing, each of line-of-sights 20 and 22 connects two hardware elements or platform of the homing.

Also shown in FIG. 2A, is the distance D between guided vehicle 10 and line-of-sight 20. The distance D is related to the angle $\lambda_T-\lambda_f$ via the range $R_{IF}$ from illuminator 18 to guided vehicle 10 (in the absence of an active illumination, $R_{IF}$ is the range from the designator or tracking system to guided vehicle 10):

$$D = R_{If}(\lambda_T - \lambda_f). \quad \text{(EQ. 5)}$$

FIG. 2A illustrates the CLOS positions and velocities at a particular time-instance. According to the CLOS technique, the guided vehicle 10 is controlled to align to the line-of-sight 20, namely to reduce as much as possible the distance D, between guided vehicle 10 and a line-of-sight 20 of the target as viewed by the hardware element or platform (e.g., illuminator, tracking system, launcher) at which the designator is defined. An ideal trajectory of guided vehicle 10, as a function of time t, for five exemplified time points $t_0<t_1< \ldots <t_4$, is illustrated in FIG. 2B. As shown, the guidance goal is achieved when guided vehicle 10 is on the line-of-sight 20 at each of the exemplified time points, thereby aligning the guided vehicle 10 to the instantaneous line-of-sight 20. To achieve this guidance goal, guided vehicle 10 is continuously accelerated transversally. The law that describes the CLOS technique can be mathematically formulated as:

$$a_f = k(j\omega) \cdot D \quad \text{(EQ. 6)}$$

where k(jω) is a mathematical transform to the frequency domain (e.g., Laplace transform or Fourier transform) of coefficients of the differential equation, ω is the frequency, and j is the imaginary number satisfying $j^2=-1$.

Similarly to the case of the PN technique, equation EQ. 6 is repeatedly applied by the homing loop. A difference between the PN homing loop and the CLOS homing loop is that in the absence of saturation or other non-linearities, the CLOS homing loop essentially solves a linear differential equation with constant coefficients. This is because the angle $\lambda_T-\lambda_f$ is proportional to the inverse of the range $R_{IF}$, and so the dependence of of on the time-varying parameter $R_{IF}$ is canceled at each loop. Since the CLOS horning loop is linear time-invariant, a homing time of around three times the loop time constants is required by the guided vehicle to have a minimum miss distance, instead of the required 10 times the loop time constant as required when PN laws are applied.

In CLOS, the target tracking is performed by a tracking system positioned generally near the designator or by a tracking system carried by the guided vehicle. For a tracking system positioned near the designator, the error in length units increases as guided vehicle 10 approaches target 14, unlike the case of PN. For a tracking system carried by guided vehicle 10, the error in length units decreases as guided vehicle 10 approaches target 14, similar to the case of PN.

In CLOS, the required transverse acceleration of guided vehicle 10 in response to a transversely accelerating target is approximately the same as, and may also be less than, the transverse acceleration performed by the target. However, additional transverse acceleration is required to follow the curved trajectory shown in FIG. 2B. In order to estimate the amount of this additional transverse acceleration, an ideal CLOS situation, in which the longitudinal velocities $V_f$ and $V_T$ are constant, is considered. In such situation, guided vehicle-target range $R_{fT}$ (the range from the guided vehicle 10 to the target 14) satisfies:

$$R_{fT} * \dot{\lambda}_f = V_f \sin(\lambda_f - \gamma_f) - V_T \sin(\lambda_T - \gamma_T) \quad \text{(EQ. 7)}$$

$$\dot{R}_{fT} = V_T \cos(\lambda_T - \gamma_T) - V_f \cos(\lambda_f - \gamma_f) \quad \text{(EQ. 8)}$$

Using an alignment condition $\lambda_f=\lambda_T=\lambda$, and differentiating E.Q. 7 with respect to the time, one obtains:

$$\dot{R}_{fT}\dot{\lambda}+T_{fT}\ddot{\lambda}=V_f\cos(\lambda-\gamma_f)(\dot{\lambda}-\dot{\gamma}_f)-V_T\cos(\lambda-\gamma_T)(\dot{\lambda}-\dot{\gamma}_T), \quad \text{(EQ. 9)}$$

$$\dot{R}_{fT}\dot{\lambda}+T_{fT}\ddot{\lambda}=(V_f\cos(\lambda-\gamma_f)-V_T\cos(\lambda-\gamma_T))\dot{\lambda}-V_f\cos(\lambda-\gamma_f)\dot{\gamma}_f+V_T\cos(\lambda-\gamma_T)\dot{\gamma}_T, \quad \text{(EQ. 10)}$$

$$2\dot{R}_{fT}\dot{\lambda}+R_{fT}\ddot{\lambda}=-V_f\cos(\lambda-\gamma_f)\dot{\gamma}_f+V_T\cos(\lambda-\gamma_T)\dot{\gamma}_T, \quad \text{(EQ. 11)}$$

$$\alpha_f=V_f\dot{\gamma}_f, \quad \text{(EQ. 12)}$$

$$\alpha_T=v_T\dot{\gamma}_T, \text{ and} \quad \text{(EQ. 13)}$$

$$\alpha_f\cos(\lambda-\gamma_f)=\alpha_T\cos(\lambda-\gamma_T)-2\dot{R}_{fT}\dot{\lambda}-R_{fT}\ddot{\lambda}. \quad \text{(EQ. 14)}$$

The first term in the RHS of EQ. 14, $\alpha_T\cos(\lambda-\gamma_T)$, represents the target transverse acceleration normal to the line-of-sight 20, The other two terms in the RHS of EQ. 14 represent the part of transverse acceleration of guided vehicle 10 that is required to compensate the rotation of the line-of-sight 20. This estimated function is typically used as a feed-forward term in the CLOS homing loop. Oftentimes, the transverse acceleration of guided vehicle 10 that is required for compensating the rotation of line-of-sight 20 is considerably higher than the transverse acceleration required in response to the transverse acceleration of target 14. This is unlike the PN case in which there is no rotation of the line-of-sight, and therefore there is no need to transverse accelerate guided vehicle 10 in order to compensate rotation.

Thus, the PN technique is advantageous from the standpoint of the ability to home on distant targets, and from the standpoint that no transverse acceleration is required to compensate rotations of the line-of-sight between the guided vehicle and the target, but is disadvantageous from the standpoint of the homing time required for successful homing, and from the standpoint of relatively high transverse accelerations required in response to the transverse acceleration of the target. Conversely, the CLOS technique is advantageous from the standpoint of the homing time required for successful homing, and from the standpoint of relatively low transverse acceleration that is required in response to the transverse acceleration of the target, but is disadvantageous from the standpoint that, when no tracking system is carried by the guided vehicle, only short range homing can successfully be achieved (illuminator to target limited range), and from the standpoint of the transverse acceleration required to compensate for line-of-sight rotations resulting from target velocity.

While conceiving the present invention it has been hypothesized, and while reducing the present invention to practice it has been realized that it is possible to enjoy the advantages of both CLOS and PN, and even outperform them, by creating non rotating virtual references.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways. Further, the invention is applicable for two- and three-dimensional configurations and scenarios, although some of the drawings show planar views for clarity of presentation.

Figure 3:
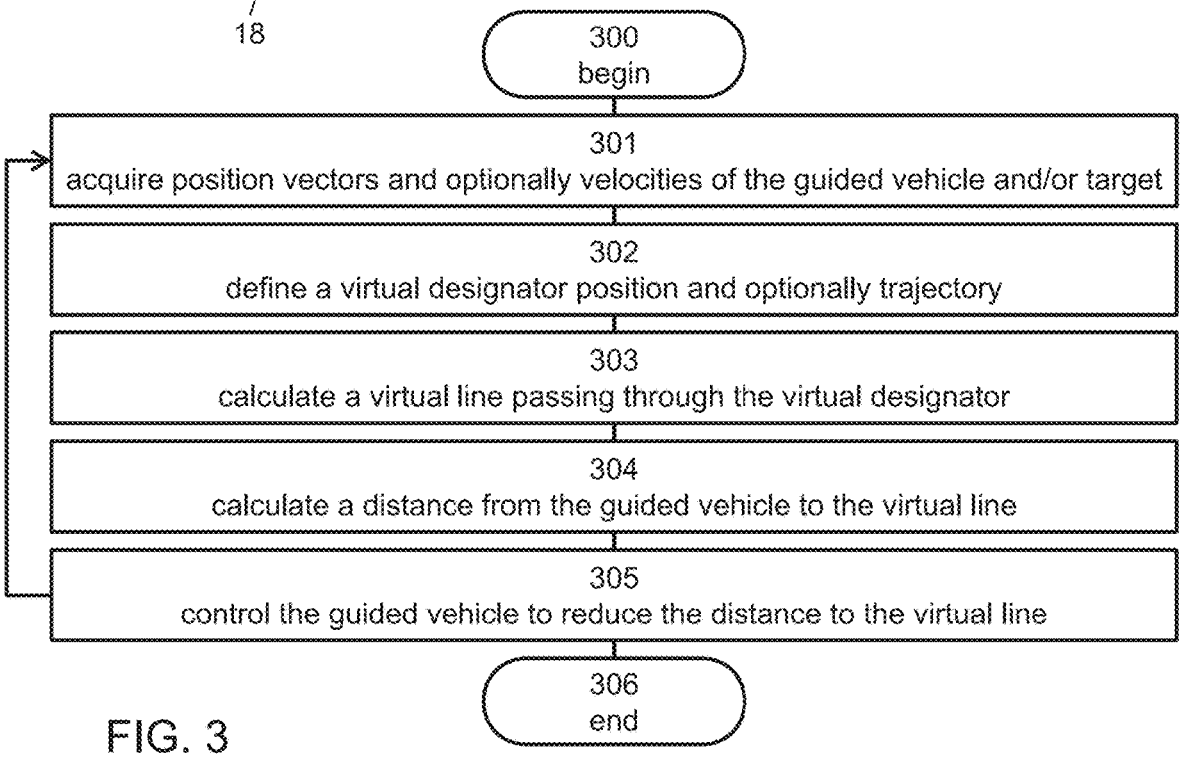
FIG. 3 is a flowchart diagram illustrating a homing method suitable for guiding a guided vehicle to a target, according to some embodiments of the present invention.

FIG. 3 is a flowchart diagram illustrating a homing method suitable for guiding a guided vehicle to a target, according to some embodiments of the present invention. The guided vehicle can be of any type that can be guided remotely or autonomously. The guided vehicle can be an aerial guided vehicle (e.g., a missile, a guided bomb, a drone, an unmanned aerial guided vehicle), a ground guided vehicle (e.g., an autonomous ground guided vehicle, an unmanned ground guided vehicle), an aqueous or subaqueous guided vehicle (e.g., torpedo), an amphibious guided vehicle, a semi-amphibious guided vehicle, a spacecraft, and the like. The guided vehicle can be launched from a stationary location or from another guided vehicle, e.g., a moving guided vehicle, such as, but not limited to, a ship, an aircraft, a drone, or a truck.

The target can be a stationary target or a moving target. For example, the target can be a manned or unmanned aerial guided vehicle or a manned or unmanned ground guided vehicle or a manned or unmanned aqueous guided vehicle or a manned or unmanned subaqueous guided vehicle or a manned or unmanned amphibious guided vehicle or a manned or unmanned semi-amphibious guided vehicle or a manned or unmanned spacecraft. The target can alternatively be a building, or a bunker or a protected aircraft hangar or a storehouse or a construction site or a plant or a space station or the like. In some embodiments of the present invention the guided vehicle is a missile and the target is a missile or a rocket (e.g., an artillery rocket) or another guided or unguided flying object such as a balloon or a drone, in some embodiments of the present invention the guided vehicle is a missile and the target is an aircraft or unmanned aerial guided vehicle, and in some embodiments of the present invention the guided vehicle is a missile and the target is a battleship or a submarine.

The method begins at 300 and optionally and preferably continues to 301 at which position vectors and optionally and preferably also velocities of the guided vehicle and the target are acquired. The acquisition can be done by measurement or by estimation. The measurements can be performed by any tracking technique known in the art. The measurements are typically done by a tracking system having a circuit configured to acquire position vectors. The measurements can be by a tracking system that is carried by the vehicle or a tracking system not carried by the vehicle. The tracking system can acquire the position vectors using electromagnetic and/or electrooptical signals emitted or reflected by the guided vehicle and/or the target.

Optionally, an illuminator is also employed for illuminating the target and optionally the guided vehicle by electromagnetic radiation. The illuminator and the tracking system can be positioned together or separately in a ground station, or carried by the guided vehicle or by a carrier other than the guided vehicle. Such a carrier can be, for example, an aircraft, a drone, a ship, or a ground carrier. Representative examples of electromagnetic radiation that can be used by the illuminator, the tracking system and/or the guided vehicle, include, without limitation, IR, Laser, Visible, or other electrooptical signals.

Also contemplated, are tracking systems employing passive tracking techniques which are not based on active illumination. Such passive tracking techniques include, without limitation, TV tracking, in which the source of illumination is typically the sun, IR tracking which is based on IR radiation thermally emitted from the target, or global position-based tracking in which the position is based on data from a global positioning system (GPS). When passive tracking is employed for the target and/or guided vehicle, it is not necessary to illuminate the target and/or guided vehicle, respectively.

The measurement of the position vector of the guided vehicle can be by a tracking system employing any one or more of the aforementioned techniques, and may alternatively or additionally employ any other tracking technique. For example, the tracking system can, in some embodiments of the present invention, be or comprise, an Inertial Navigation System (INS), as known in the art.

The position vectors acquired at 301 can be relative. In these embodiments, the method typically acquires a position vector of the target relative to the vehicle. The position vectors can alternatively be absolute with respect to a predetermined reference point; for example, a reference point at which a hardware element (e.g., a designator, an illuminator, a launcher, a tracker) is placed. In these embodiments, the position vector of the guided vehicle and the position vector of the target are acquired relative to the same predetermined reference point. Also contemplated, are combinations of the above embodiments. For example, the method can acquire the position vector of the target relative to the vehicle, and the position vector of the guided vehicle relative to the predetermined reference point. It is appreciated that such combination allows also calculating the position vector of the target relative to the same predetermined reference point, using vector subtracti on.

The method optionally and preferably continues to 302 at which a position and optionally and preferably also a trajectory of a virtual designator is defined, based on the position vectors and optionally the velocities of the guided vehicle and the target.

The virtual designator is preferably defined at a position other than the position of the illuminator used to illuminate the target. The virtual designator is referred to as "virtual" since at any time $t>t_0$, where $t_0$ is the time at which the guiding of the vehicle begins, the virtual designator is preferably defined at a position other than the position of the guided vehicle and other than the position of any other homing hardware element (e.g., a designator, an illuminator, a launcher, a tracker). As will be exemplified below, the present embodiments contemplate situations in which at time $t=t_0$ the virtual designator is defined at the initial position of the guided vehicle, but this need not necessarily be the case, since the virtual designator can be defined a position other than the initial position of the guided vehicle.

The virtual designator serves as a reference point for a three-point alignment law employed according to some embodiments of the present invention, where the three points optionally and preferably include the virtual designator, the guided vehicle and the target. The virtual designator may in some embodiments of the present invention be stationary and in some embodiments of the present invention be moving along a virtual trajectory towards a virtual collision point with the target.

At 303 a virtual line to be used as a reference line for the guidance is calculated, optionally and preferably using the position of the virtual designator, as one of the points through which the virtual line passes.

Figure 4:
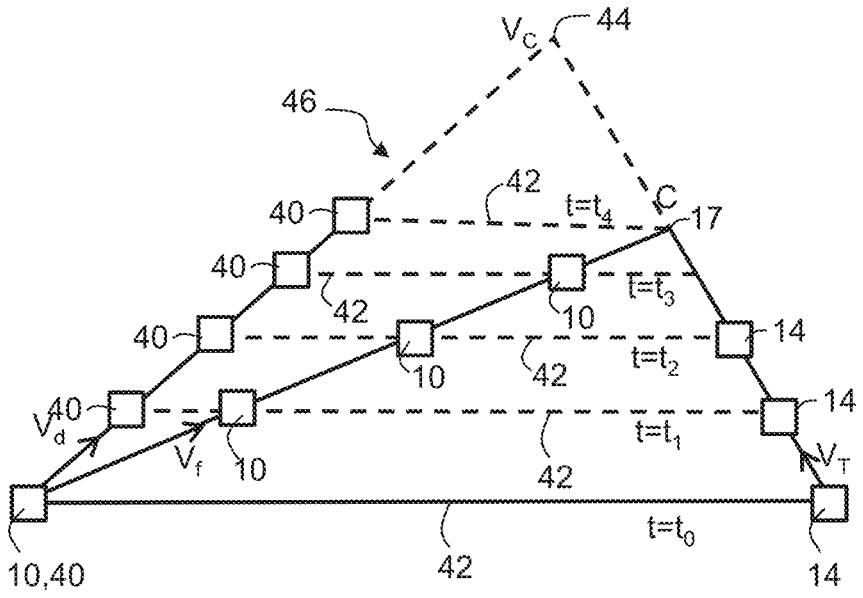
FIG. 4 is a schematic illustration of an exemplified embodiment of the present invention in which the virtual designator is moving, and in which initially the virtual designator and the guided vehicle are the same location.

In some embodiments of the present invention a virtual designator trajectory is defined by controlling the position of the virtual designator according to a PN law, or PN constant LOS direction characteristics, with a defined objective to virtually collide with the target at a virtual collision point $V_C$, as further detailed hereinbelow (see FIGS. 4, 5, and 9B). These embodiments are advantageous because there are almost no physical constraints for the motion of the virtual designator, and so its position can be ideally controlled by PN laws, and assure that the instantaneous virtual lines connecting it to the target move in space, optionally and preferably without rotation.

Under other possible scenarios, for example, when the target is static or is moving at slow velocity compared to the guided vehicle, the position of the virtual designator can be at a fixed point in space. In this case, the virtual line is nearly constant, and the guided vehicle can be Controlled similarly to the CLOS laws to converge towards this virtual line.

At 304 a distance from the guided vehicle to the virtual line is calculated, and at 305 the guided vehicle is commanded by providing it with transverse acceleration commands to reduce the calculated distance. This can be done by transmitting control signals to the steering and/or accelerating system of the guided vehicle so as vary one or more of its velocity vector components, and to ensure that it moves closer to, or remains on, the virtual line. This can be better understood from FIG. 15, which schematically illustrates the guided vehicle 10, the target 14, the virtual designator 40, and the virtual line 42, according to some embodiments of the present invention. Guided vehicle 10 is at a distance D from virtual line 42 and the method preferably commands guided vehicle 10 to reduce the distance D. The guided vehicle is optionally and preferably commanded similarly to CLOS laws up to a collision point C, as further detailed hereinbelow (see FIGS. 4, 5, and 9B, described below).

The definition of the virtual line is optionally and preferably calculated repeatedly, and the distance between the guided vehicle and the virtual line is also calculated repeatedly. Operations 301-305 define a cycle of the homing loop of the present embodiments. From 305 the method optionally and preferably loops back to 301 for executing another homing loop cycle. The method ends 306. The information obtained by the method, for example, the range between the guided vehicle and the target, can be transmitted to other systems (e.g., self-destruction system, proximity detonating system, and the like).

The preferred measurements performed at 301 include: the angular difference between the line connecting the virtual designator and the guided vehicle and the line connecting the virtual designator and the target, the ranges to the guided vehicle and the target. Optionally and preferably, but not necessarily ranges rates measurements or estimations are also executed at 301.

The measurements employed by the method can be by any known sensor configuration. For example, in some embodiments of the present invention a CLOS sensor configuration is employed. In these embodiments, separate tracking is executed for the guided vehicle and the target. The tracking can be based on measurements and/or estimations, and can be continuous or employ a time sharing protocol between the tracking of the guided vehicle and the tracking of the target. In some embodiments of the present invention a PN sensor configuration is employed. Iii these embodiments, the range between the guided vehicle and the target is obtained, by measurement or by estimation. In some embodiments of the present invention a Global Positioning System (GPS) is employed. These embodiments are particularly useful when the target is stationary. Combinations among two or more of the above configurations are also contemplated.

Before providing a further detailed description of the homing technique of the present embodiments, as delineated hereinabove, attention will be given to the advantages and potential applications offered thereby.

By using the PN laws to define the virtual designator and by commanding the guided vehicle in a manner similar to the CLOS laws, the homing technique of the present embodiments enjoys the advantages of both PN and CLOS.

The virtual designator trajectory can be calculated to ensure that the instantaneous virtual line connecting it to the target is shifted parallel to itself, without rotation. This is optionally and, preferably achieved by commanding the virtual designator under PN laws, without being restricted by physical limitations, such as limits on the transverse acceleration, the time response, and others.

Although controlled similarly to CLOS laws, the instantaneous guided vehicle velocity and its resulting trajectory are directed towards the collision point C (see, e.g., FIGS. 4, 5, 9B, described below) and not to the instantaneous target position (as, e.g., in FIG. 2B).

Being controlled by similar to CLOS laws, the guided vehicle time response is about three times shorter compared to the time response achievable by PN laws.

Being controlled by similar to CLOS laws, the transvers accelerations required by the guided vehicle to overcome possible target maneuvers are of the same order of magnitude as the target's transverse acceleration. Such required transvers accelerations are about three times smaller than would have been required had the guided vehicle been commanded according to the PN laws.

For a target moving at a constant velocity, although the guided vehicle is controlled by CLOS laws, no transverse accelerations are required for ensuring a collision between the guided vehicle and the target, because the instantaneous guided vehicle's velocity and its resulting trajectory are directed towards the collision point C (see, FIGS. 4, 5 and 9B, described below) and not to the instantaneous target position (see FIG. 2B).

Unlike the conventional CLOS technique in which the distance is calculated between the guided vehicle and the actual line-of-sight between two physical objects (the illuminator and the target), the present embodiments calculate a distance to a virtual line, since it does not pass through the illuminator. It is appreciated that in conventional CLOS the line-of-sight is a line that is defined by the illuminator. The line used by the method of the present embodiments is referred to as "virtual" because no real radiation is transmitted by the virtual designator. As explained above, and will be shown below, such a virtual line provides a significant improvement to the homing loop.

The virtual line can be viewed as a line-of-sight connecting the virtual designator either with the physical target, or with the predicted collision point between the guided vehicle and the target. The guidance can be viewed as a three-point navigation law, which considers the positions of the virtual designator, the guided vehicle and the target. Since there is no physical illuminator at the virtual designator, there are no emissions from the virtual designator in order to illuminate the target. The virtual designator can be static at a fixed location in space, or it can be moving.

A static virtual designator in space is particularly useful, in situations in which it is desired to intercept a static target, or a target moving along a predictable direction for a sufficiently long period of time. A representative example is a case in which a target is approaching a site or an object and the guided vehicle is launched from a location that is not along the target-object line-of-sight. In such cases, the static position in space of the virtual designator can be defined to be at the location of the site or object, so that there is a virtual collision trajectory between the virtual designator and the target. In military applications, this situation is typical for short range area defense, whereby the guided vehicle (e.g., a missile) is launched from a launching platform in order to defend a site nearby the launching platform from an approaching target (e.g., missile or rocket). Another representative example for a static virtual designator is a case in which a target is stationary, in which case the static position of the virtual designator is preferably defined to be at the location of the target itself, thus imposing virtual collision between the virtual designator and the target.

When the virtual designator is moving in space, it optionally and preferably moves along a virtual collision trajectory in space towards a virtual collision between the virtual designator and the target. However, it is appreciated that it is not desired to ultimately achieve a collision event between the virtual designator and the target. Thus, according to some embodiments of the present invention the position and velocity of the virtual designator are selected such that a collision between the guided vehicle and the target occurs before the virtual designator virtually collides with the target. This can be achieved by selecting the velocity of the virtual designator to be less than the velocity of the guided vehicle, and/or by ensuring that the range from the virtual designator to the target is larger than or equals to the range from the guided vehicle to the target, throughout the homing loop.

Generally, the motion characteristic of the virtual line comprises a translation component. Preferably, the motion characteristic of the virtual line is devoid of any rotational component, in which case the virtual line can be continuously or repeatedly shifted parallel to itself. This is advantageous because it saves on transverse acceleration resources that would have been required to compensate for the rotation of the line had it been a line-of-sight between two physical objects. While the virtual line preferably does not pass through the illuminator during the motion of the guided vehicle, the present embodiments contemplate applications in which the virtual line initially (e.g., at time $t=t_0$) passes through the physical illuminator and the target, but then moves, optionally and preferably parallel to itself, such that it passes through the target but not through the physical illuminator and the guided vehicle.

The virtual line can be defined by means of transformation of coordinates. As a simplified example, which is not to be considered as limiting, consider a case in which at time $t=t_0$ the virtual line passes through a static physical illuminator and the target. Denote the position of the physical illuminator, relative to the origin of some coordinate system by the vector u, and the direction from the physical illuminator to the target at time $t=t_0$ by the vector w, where underlined symbols denote vector quantities. The virtual line at time $t=t_0$ can be parameterize as $f=u+pw$, where p is a parameter of the virtual line. In this parameterization, $p=0$ corresponds to the location of the physical illuminator, and there is some value of $p\neq 0$ for which f describes the location of the target relative to the origin. Suppose that due to the motion of the target, the direction from the physical illuminator to the target at time $t_1=t_0$ is $w_1\neq w$, so that the (non-virtual) line-of-sight from the physical illuminator to the target becomes $f_1=u+pw_1$, where, again, there is some value of the parameter p for which $f_1$ describes the location of the target. Suppose further that it is desired to shift the virtual line parallel to itself. Since both the position vector $f_1$ of the target and the direction $w_1$ are known, a coordinate transformation can be applied so as to compensate for the change $w\rightarrow w_1$ while ensuring that the line still passes through the target. Typically, the coordinate transformation includes a translation matrix and a rotation matrix. The translation matrix can shift the origin of the coordinate system by the amount of the target's displacement between $t=t_0$ and $t=t_1$, and the rotation matrix can be characterized by a rotation angle $\varphi$, satisfying $\cos\varphi = w \cdot w_1/(|w||w_1|)$.

The virtual line can also be defined by first selecting the location of the virtual designator in space and then defining the virtual line based on this location. For example, the virtual line can pass through the virtual designator and the target, or through the virtual designator and a predicted final position of the target. The latter embodiment is particularly usefully when a ZEM is calculated as further detailed hereinbelow. In any of the embodiments described herein the selected initial location of the virtual designator can be at the launching platform of the guided vehicle, or at a location of a different object or site (e.g., an object or a site to be defended against the target), or at any other location (see e.g., FIG. 6).

The technique of the present embodiments requires small lateral accelerations at the final phase of intercept compared to PN and CLOS similar scenarios. This is because the virtual line can be selected such that the angle $\lambda$ remains nominally fixed, resulting in zero or small time derivatives of $\lambda$, and a significant simplification of EQ. 14, leaving only the term that represents the transverse acceleration of the target, without adding the aforementioned transverse acceleration contribution for compensating the rotation of the line-of-sight.

The technique of the present embodiments provides a dynamic response which is significantly faster than PN. This is because the governing equation is a differential equation with generally near constant or slowly varying coefficients. The equation's solution convergence and small miss distance can be achieved generally after about three loop time constants. It was found that the needed homing time of the homing loop of the present embodiments is shorter than 3 times that of the PN homing loop. Such a faster response is particularly useful when the target performs escape maneuvers, or uses jamming techniques such as electronic warfare or the like.

Another advantage of the technique of the present embodiments is that it allows controlling the collision angle between the guided vehicle and a static or slow moving target, a feature that was heretofore difficult to implement by the conventional techniques. An additional advantage is that late escape maneuvers at end of homing, at a range near the target is achievable in ratio 3/10 as compared to PN.

The technique of the present embodiments can be used in many military and civilian applications. In military applications, the technique of the present embodiments can be used for intercepting and optionally and preferably destroying static or moving enemy targets. For example, the technique of the present embodiments can be implemented in a surface-to-air, surface-to-sea, surface-to-surface, air-to-surface, air-to-sea, air-to-air, sea-to-surface, sea-to-sea, and sea-to-air missile guiding systems. In civilian applications, the technique of the present embodiments can be used for guiding a guided vehicle to a specific location, in which case the specific location is defined as the target. For example, the technique of the present embodiments can be used for performing automatic landing for manned or unmanned guided vehicles, or for automatically controlling air refueling systems. The technique of the present embodiments can also be used in the space field, e.g., for automatic docking, berthing of spacecraft (e.g., space rendezvous), or for guided landing on a planetary body.

The guidance errors of the technique of the present embodiments depend on the tracking system employed during the homing loop. When the target is tracked from a fixed ground tracking system, the main measured error sources are constant in angle, so that the error in terms of the length units is increasing as the guided vehicle approaches the target, and the range between the target and the ground tracking system increases. This result is similar to the classic CLOS technique. When the target is tracked by a homing head carried by the guided vehicle, the main error sources are constant in angle, so the error in terms of the length units is decreasing as the guided vehicle approaches the target. This characteristic is similar to PN or to CLOS with on-board tracking system, and allows small miss distance for long range targets.

Following is a mathematical description of the law that describes the guidance technique of the present embodiments. According to some embodiments of the present invention both the guided vehicle-target and the virtual designator-target line-of-sights tend ideally to form the same angle with the reference direction. Denoting by $\lambda_{fT}$ the angle that the guided vehicle-target line-of-sight forms with the reference direction, and by $\lambda_{dT}$ the angle that the virtual designator-target line-of-sight forms with the reference direction, these embodiments can be written mathematically as:

$$\lambda_{fT} = \lambda_{fT} = \lambda. \quad \text{(EQ. 5)}$$

Note that EQ. 15 corresponds to a definition that $\lambda$ ios the angle between the virtual line-of-sight and the reference directiob.

The mathematical expression that describes the embodiments that the motion of the virtual line is devoid of a rotational component can be written as:

$$\dot{\lambda} = 0$$

$$\ddot{\lambda} = 0 \quad \text{(EQs. 16)}$$

In these embodiments, EQ. 14 above is simplified to the following relation between the transverse accelerations of the guided vehicle and the target $$a_f \cos\delta_f = a_T \cos\delta_T, \quad \text{(EQs. 17)}$$

where $\delta_f = \gamma_f - \lambda_{fT}$, and $\delta_T = \gamma_T - \lambda_{dT}$, are the angles that the velocities of the guided vehicle and the target form with the virtual line. The magnitudes of the lateral accelerations of the guided vehicle and the target are the same or approximately the same.

The velocities $V_T$, $V_f$, and $V_d$, of the virtual designator, the guided vehicle, and the target, relate to each other by:

$$V_T \sin\delta_T = V_f \sin\delta_f = V_d \sin\delta_d \quad \text{(EQs. 18)}$$

where $\delta_d = \gamma_d - \lambda_{dT}$ is the angle that the velocity vector $V_d$ of the virtual designator forms with the virtual line, and $\gamma_d$ is the angle that the velocity vector $V_d$ of the virtual designator forms with the reference direction.

It is noted that when $V_f > V_T$, then $(\lambda_{fT} - \gamma_f) > (\lambda_{dT} = \gamma_T)$ and so of $a_f < a_T$. Therefore, for a given guided vehicle having given capabilities and given hardware, the present embodiments can achieve a better homing for targets having more acceleration maneuver capabilities, compared to the conventional PN and CLOS techniques. It was found by the Inventors that the present embodiments, for the same target, can achieve a successful horning for targets with acceleration maneuvers that are three times larger than the acceleration maneuvers for which successful homing can be achieved conventionally.

The guidance law and the homing loop can be the same as for the CLOS guidance law and the homing loop described above (see EQ. 6), except that the distance D is now defined between the guided vehicle and the non-rotating virtual line, rather than between the guided vehicle and the CLOS rotating designator-target line-of-sight. The error signal of the homing loop is therefore the distance D between the guided vehicle and the virtual line, and the homing loops attempts to reduce this distance.

As stated, the virtual designator can be either a static virtual designator or a moving virtual designator. When the virtual designator is moving, it is optionally and preferably, but not necessarily, moving along a virtual collision trajectory with the target, preferably at a velocity having a constant magnitude. The initial location of the virtual designator can be selected arbitrarily, or it can be at some specific location, such as, but not limited to, the initial location of the guided vehicle, the location of the physical illuminator, and the like. This virtual designator has almost no limitations on its virtual acceleration and small virtual response time.

For stationary targets, or target that move relatively slowly compared to the velocity of the vehicle (e.g., $|V_T|/|V_f|$ less than 0.5 or less than 0.1 or less than 0.01), the virtual designator can be defined at the target's location.

Against a sufficiently fast moving target (e.g., $|V_T|/|V_f|$ if of at least 0.5), the virtual designator is optionally and preferably, but not necessarily, a moving virtual designator, wherein the virtual line between the virtual designator and the target optionally and preferably moves parallel to itself. This is advantageous since it avoid the requested high transverse acceleration due to the aforementioned rotation in the CLOS technique. The relation between the velocities of the virtual designator and the target can be written as:

$$V_d \sin(\lambda-\gamma_d)=V_T \sin(\lambda-\gamma_T) \quad \text{(EQ. 19)}$$

and the virtual transverse acceleration of the virtual designator can optionally and preferably, but not necessarily, be calculated according to the PN law:

$$\alpha_d=N\cdot V_{dC}\dot{\lambda} \quad \text{(EQ. 20)}$$

where $V_{dC}$ is the closing velocity between the virtual designator and the target.

Figure 5:
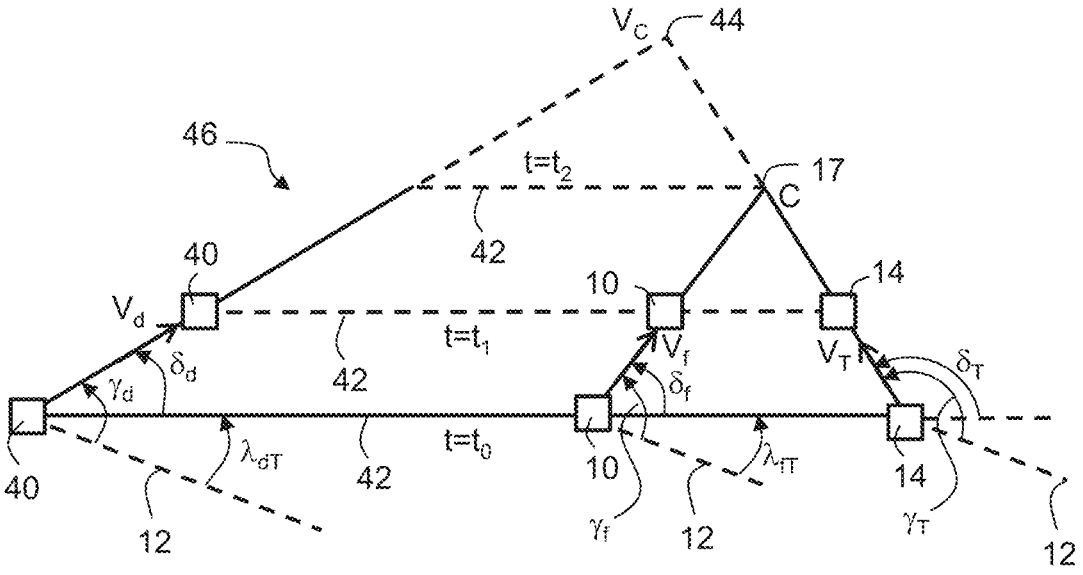
FIG. 5 is a schematic illustration an exemplified embodiment of the present invention in which a virtual designator is moving, and in which the initial positions of the virtual designator and the guided vehicle differ.

Referring now again to the drawings, FIG. 5 schematically illustrates an exemplified embodiment in which the virtual designator 40 is moving, and in which the initial positions of the virtual designator 40 and the guided vehicle 10 differ. The illustration is for three time points $t_0<t_1<t_2$. As illustrated, the motion characteristics of the virtual line 42 are devoid of any rotational component, namely line 42 is shifted parallel to itself. The transverse acceleration command of of the guided vehicle is calculated continuously or intermittently so as to ensure that the distance D (not shown, see FIG. 15) between guided vehicle 10 and the virtual line 42 is decreased.

FIG. 5 explicitly shows the velocities and angles described above. Specifically, $V_d$ is the velocity of the virtual designator 40, $\gamma_d$ is the angle between the velocity vector $V_d$ of the designator 40 and the reference direction 12, $\gamma_d$, $\gamma_f$ and $\delta_T$ are the angles between the virtual line 42 and the velocity vectors of the designator 40, the guided vehicle 10, and the target 14, respectively, $\lambda_{dT}$ is the angle that the line-of-sight between the virtual designator 40 and the target 14 forms with the reference direction 12, $\lambda_{fT}$ is the angle that the line-of-sight between the guided vehicle 10 and the target 14 forms with the reference direction 12, and $V_f$, $V_T$, $\gamma_f$, and $\gamma_T$ are as defined hereinabove. FIG. 4 schematically illustrates an exemplified embodiment in which the virtual designator 40 is moving and in which initially the virtual designator 40 and the guided vehicle 10 are the same location. The illustration is for five time points $t_0<t_1 \ldots <t_4$. As illustrated, that motion characteristic of the virtual line 42 is devoid of any rotational component. The transverse acceleration command of the guided vehicle is calculated continuously or intermittently so as to ensure that the distance D between guided vehicle 10 and the virtual line 42 is decreased (see, e.g., FIG. 15).

Note that the virtual designator 40 is moving along a collision trajectory 46 with the target 14. However, the motion trajectories of the target 14 and the virtual designator 40 intersect at a virtual collision ($V_C$) point 44 which is beyond the collision point 17, thereby ensuring that physical collision of guided vehicle 10 with target 14 occurs before virtual designator 40 reaches target 14. Since the virtual designator 40 is not a real guided vehicle, there is no real collision at this point, and so point 44 is referred to herein as a virtual collision point. Note further that since the guided vehicle 10 moves to reduce its distance D from virtual line 42, collision eventually occurs at the collision point 17.

Each of the repeated calculations of the homing loop optionally and preferably includes acquisition and/or evaluations of at least the locations of the guided vehicle 10, and the target 14, the calculation of the virtual line and of the distance D, and optionally the calculation of virtual designator position and trajectory (when the virtual designator is moving). As illustrated in the exemplified illustrations shown in FIGS. 4 and 5, the instantaneous locations of the guided vehicle 10 and the target 14 form a first set of triangles with the collision point 17, and the instantaneous locations of the virtual designator 40 and the target 14 form a second set of triangles with the virtual collision point 44. In various exemplary embodiments of the invention all the first triangles are similar to each other, and all the second triangles are similar to each other.

In some embodiments of the present invention, a ZEM Extension is employed. The ability of the technique of the present embodiments to maintain a substantially non-curved trajectory for the guided vehicle 10, allows defining a ZEM trajectory in a similar way to the definition of the ZEM trajectory described above with respect to the PN technique. This facilitates an easy-to-implement homing loop that takes into account the guided vehicle's predicted longitudinal acceleration, as well as the target's predicted lateral and longitudinal accelerations. guided vehicle trajectory can be obtained by command the guided vehicle to reduce the distance D either to the instantaneous virtual line passing through the virtual designator 40 and the target 14 (as shown, for example, in FIG. 2A), or to the instantaneous virtual line passing through the virtual designator 40 and the position of the target at the estimated interception time $t_{final}$ in the absence of any interception maneuver by the guided vehicle 10. This improves the performance of the homing when high accelerations, transversal or longitudinal, are applied to the guided vehicle 10 and the target 14, or against reentry guided vehicles.

Figure 6:
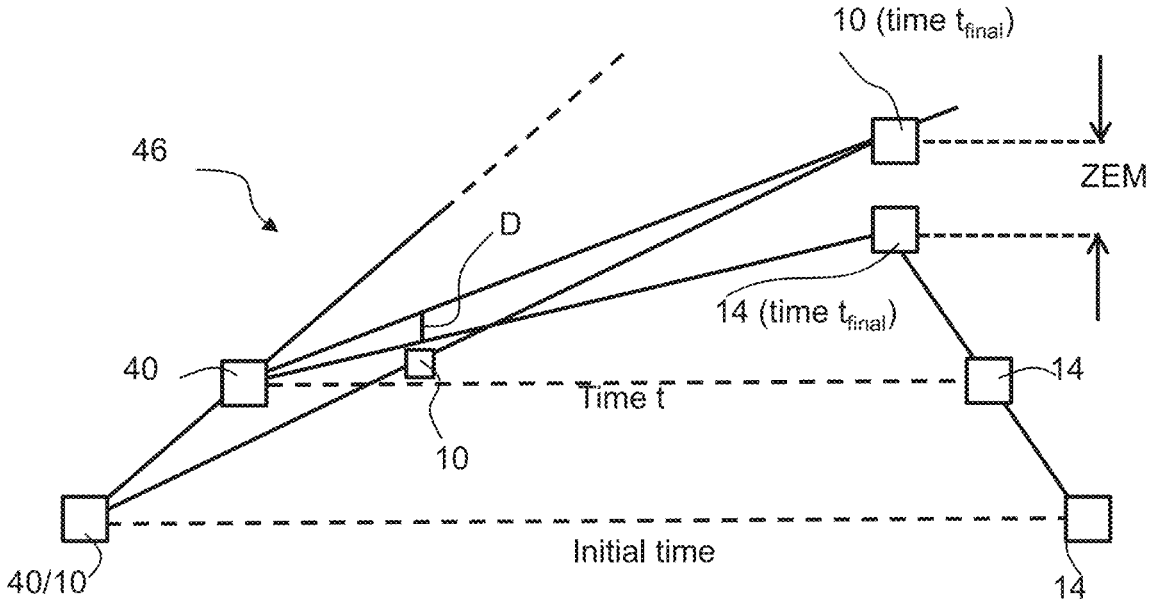
FIG. 6 is a schematic illustration of an embodiment of the present invention in which a Zero Effort Miss (ZEM) is calculated and the guided vehicle is commanded to correct D, according to some embodiments of the present invention.

FIG. 6 is a schematic illustration of an embodiment in which a ZEM is calculated wherein the calculation of the distance is based on the calculated ZEM. Shown is a situation in which the guided vehicle 10 and the virtual designator 40 are initially at the same location at $t=t_0$). The virtual designator 40 continues along trajectory 46 as described above. The position of the target at the estimated interception time $t_{final}$ is recalculated at each time point of the homing loop, and the distance D(t) at time point t is approximated using the calculated value of the ZEM, according to the formula:

$$D(t) \cong ZEM \cdot \frac{A(t)}{B(t)} \quad \text{(EQ. 21)}$$

where A(t) is the range from the position of the virtual designator 40 at time t to the position of the guided vehicle 10 at time t, and B(t) is the range from the position of the virtual designator 40 at time t to the position of the target at the estimated interception time $t_{final}$.

The present embodiments also contemplate a homing loop employing a three-point guidance law even in the case in which the target is tracked by a tracking system having a circuit and being carried by the guided vehicle. Such is not possible with conventional three-point guidance laws, which require a reference point. The ability of the technique of the present embodiments to place a virtual designator at an arbitrary location allows employing a three-point guidance law irrespectively whether or not there is a ground reference point.

Figure 7:
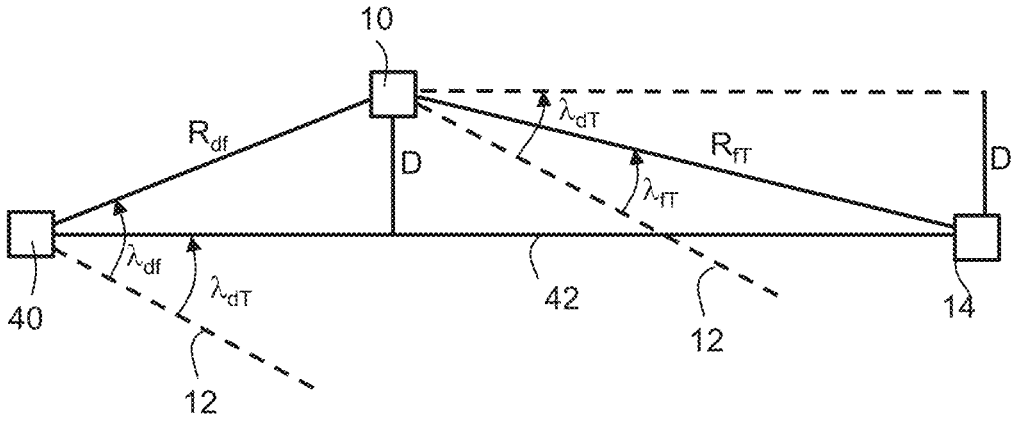
FIG. 7 is a schematic illustration of an embodiment of the present invention in which a homing loop is executed based on a position vector acquired by a tracking system carried by the guided vehicle.
Figure 8:
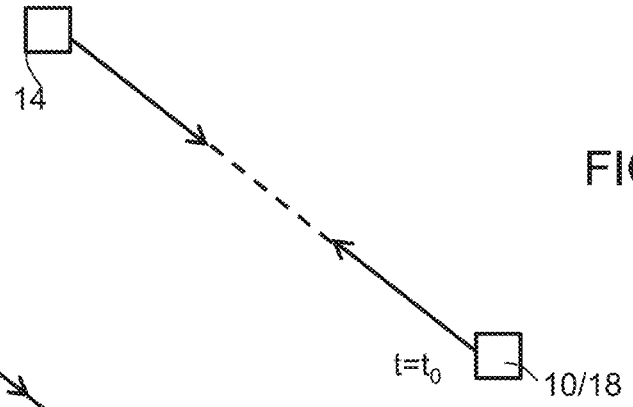
FIG. 8 is a schematic illustration of a point defense scenario.

FIG. 7 is schematic illustration of an embodiment in which the distance D can be calculated based on a target's position vector acquired by the tracking system carried by the guided vehicle. In FIG. 7, the range between the virtual designator 40 and the guided vehicle 10 is denoted by $R_{df}$, and the range between the guided vehicle 10 and the target 14 is denoted by $R_{fT}$. As shown, the distance D can relate either to the range $R_{df}$, via the angles $\lambda_{df}$ and $\lambda_{dT}$, or to the range $R_{ft}$, via the angles $\lambda_{dT}$ and $\lambda_{fT}$, according to the formulae:

$$D=R_{df}(\lambda_{df}-\lambda_{dT}) \quad \text{(EQ. 22)}$$

$$D=R_{fT}(\lambda_{dT}-\lambda_{fT}) \quad \text{(EQ. 23)}$$

Notice that EQ. 23 uses the range $R_{fT}$ and angle $\lambda_{fT}$ both of which can be measured by the tracking system carried by guided vehicle 10. Since the additional angle $\lambda_{dT}$ defines the direction of the virtual line 42 itself (relative to the reference direction 12), this embodiment allow the calculation of the distance D, and therefore the execution of the homing loop, using only measurements performed by the tracking system carried by the guided vehicle, without the need for a ground reference point. The error in terms of length unit near destination decreases with decreasing range $R_{fT}$.

The present embodiments also contemplate combining the embodiment in FIG. 7 with the embodiment in FIG. 6, wherein the ZEM is calculated using measurements performed by the tracking system carried by the guided vehicle, and the distance D is calculated using the calculated ZEM as further detailed hereinabove.

In some embodiments of the present invention the virtual line 42 and/or the location of the virtual designator 40 is calculated based on a desired direction of impact between guided vehicle and target 14, which desired direction of impact can be received as an input.

When target 14 is static, the virtual designator 40 can be initially defined far away from the target such that the virtual line 42 approaches the target 14 at the desired impact direction. The Inventors found that with such a procedure a rapid convergence is achieved, and the impact direction is assured.

When target 14 moves, for example, at a constant velocity, the angle at the collision point (see, e.g., FIG. 5) can be written as:

$$\angle C=180^0=[\delta_f+(180°-\delta_T)]=\delta_T-\delta_f, \quad \text{(EQ. 24)}$$

while from EQ. 18, one obtains $$V_f \sin(\delta_T-\angle c)=V_T \sin(\delta_T) \quad \text{(EQ. 25)}$$

For a given impact direction ∠C, EQ. 25 can be solved for the angle $\delta_T$, and so that the desired impact direction can be ensured by selecting the initial direction of the virtual line 42 at an angle of $\delta_T$ to the velocity vector $V_T$ of the target. according to the obtained value of $\delta_T$. As a representative example, for ∠C=90°, $\delta_T$ satisfies tan $\delta_T=V_f/V_T$.

Similar considerations can be applied mutatis mutandis also for the case of a target moving at a non-constant velocity.

In some embodiments of the present invention the distance D is biased, and the guided vehicle is controlled to reduce the biased distance. These embodiments are particularly useful, when it is desired to collide with a point which is shifted relative to the measured position vector of the target 14. For example, if the target is an identifiable building and it is desired to collide with a location nearby the building, or when it is desired to collide with a region of target 14 that is less detectable than another region wherein the acquired position vector of target 14 is the position of the detectable region (e.g., to collide with a non-reflective region, when the acquired position vector is a reflective region). Biasing of the distance D is optionally and preferably linear, by subtracting a bias distance $D_{bias}$ from the distance D, in which the law that describes the transverse acceleration becomes:

$$a_f=k(j\omega)\cdot(D-D_{bias}). \quad \text{(EQ. 26)}$$

In military applications, there are oftentimes situations in which it is desired to guide the guided vehicle (e.g., a missile) to collide with a target attacking the guided vehicle's own launching platform. Such a scenario is referred to as a "point defense". Conventional CLOS techniques perform point defense according to the scenario shown in FIG. 8. Illuminator 18 illuminates the target 14 and the guided vehicle 10 is launched from the same location as the illuminator 18. The guided vehicle 10 is guided to collide with the target 14. Due to rotating to geometry and acceleration limitations of available missiles, the performances of conventional CLOS techniques in area defense, e.g., when defending a nearby point, are poor.

The present embodiments successfully address the shortcomings of conventional CLOS techniques without the need to change the guided vehicle hardware. This improves area defense capabilities to a system conceived for point defense. In an area defense, the guided vehicle is launched from a location nearby the location of the site that is to be defended and that is approached by the target.

Figure 9A:
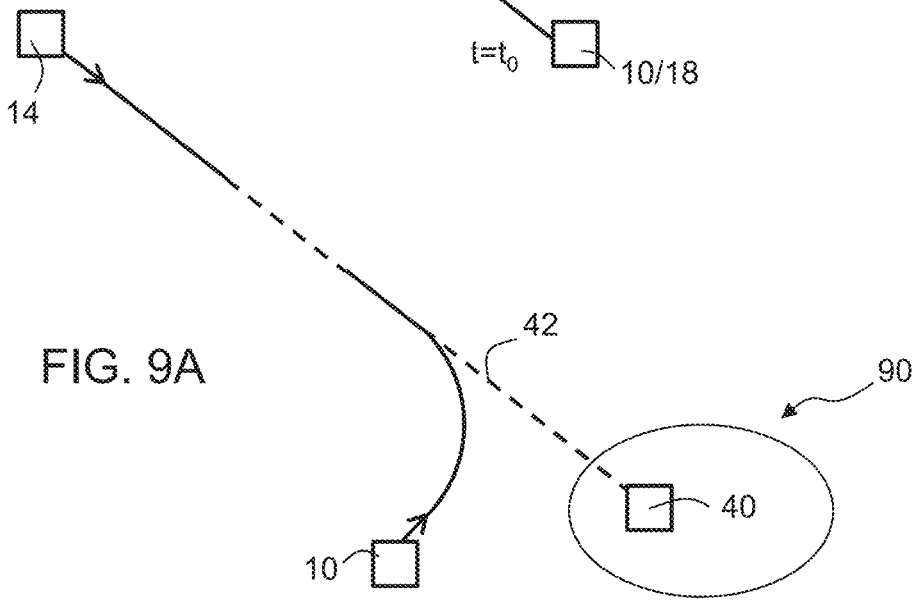
FIGS. 9A and 9B are schematic illustrations of embodiments of the present invention executed to provide area defense capabilities.
Figure 9B:
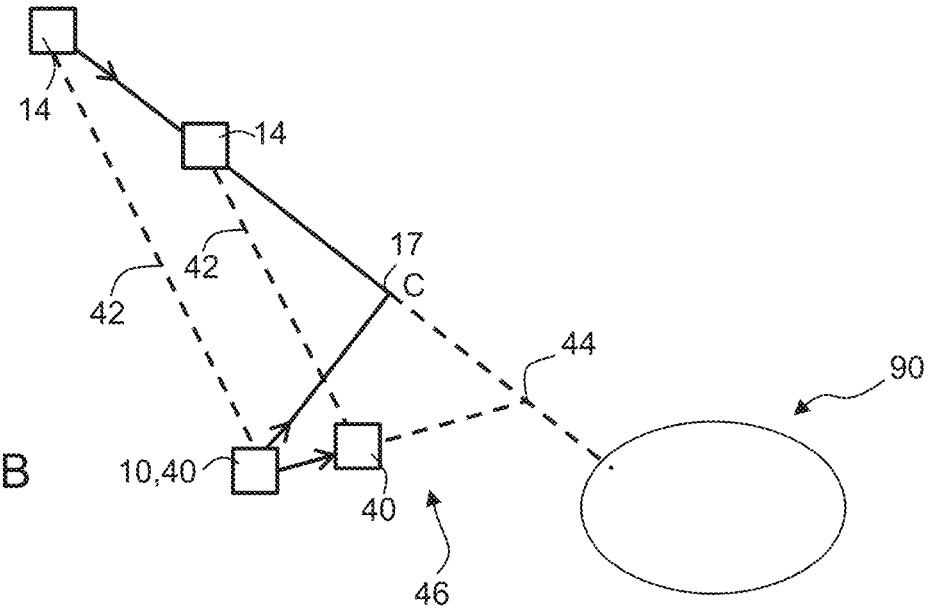

FIG. 9A illustrates an embodiment in which an area defense is executed using a virtual designator 40 at a static location. A site to be defended against target 14 is shown at 90. A guided vehicle 10 (e.g., missile) is launched from a location other than the location of site 90, preferably a location nearby (e.g., within a 1-20 km radius) site 90. The virtual designator 40 is initially defined at the site 90 and the virtual line 42 is defined between virtual designator 40 and target 14. Guided vehicle 10 is commanded to reduce the distance D between guided vehicle 10 and line 42, thereby approaching target 14. FIG. 9B illustrates an embodiment in which an area defense is executed using a moving virtual designator 40. Shown is an embodiment in which the guided vehicle 10 (e.g., missile) and the virtual designator 40 are initially at the same location nearby site 90. The motion direction of virtual designator is optionally and preferably defined such that the virtual collision point 44 is closer to the defended site 90 than the guided vehicle—target collision point 17, and the virtual line 42 is defined between virtual designator 40 and target 14. The virtual line 42 is shifted parallel to itself and the guided vehicle 10 is launched and commanded to reduce the distance D between guided vehicle 10 and line 42, thereby ensuring a collision at collision point 17 before virtual designator 40 reaches target 14.

An area defense according to the present embodiments of the invention is useful in marine application, for example, when a defending ship or a defending aircraft defends a nearby ship being attacked by a target (e.g., an attacking missile or rocket), or when a defending ship or a defending aircraft defends a nearby site (e.g., a offshore drilling rig or the like), In this case, the guided vehicle (e.g., a missile) is launched from a platform placed on the defending ship or aircraft.

Figure 10:
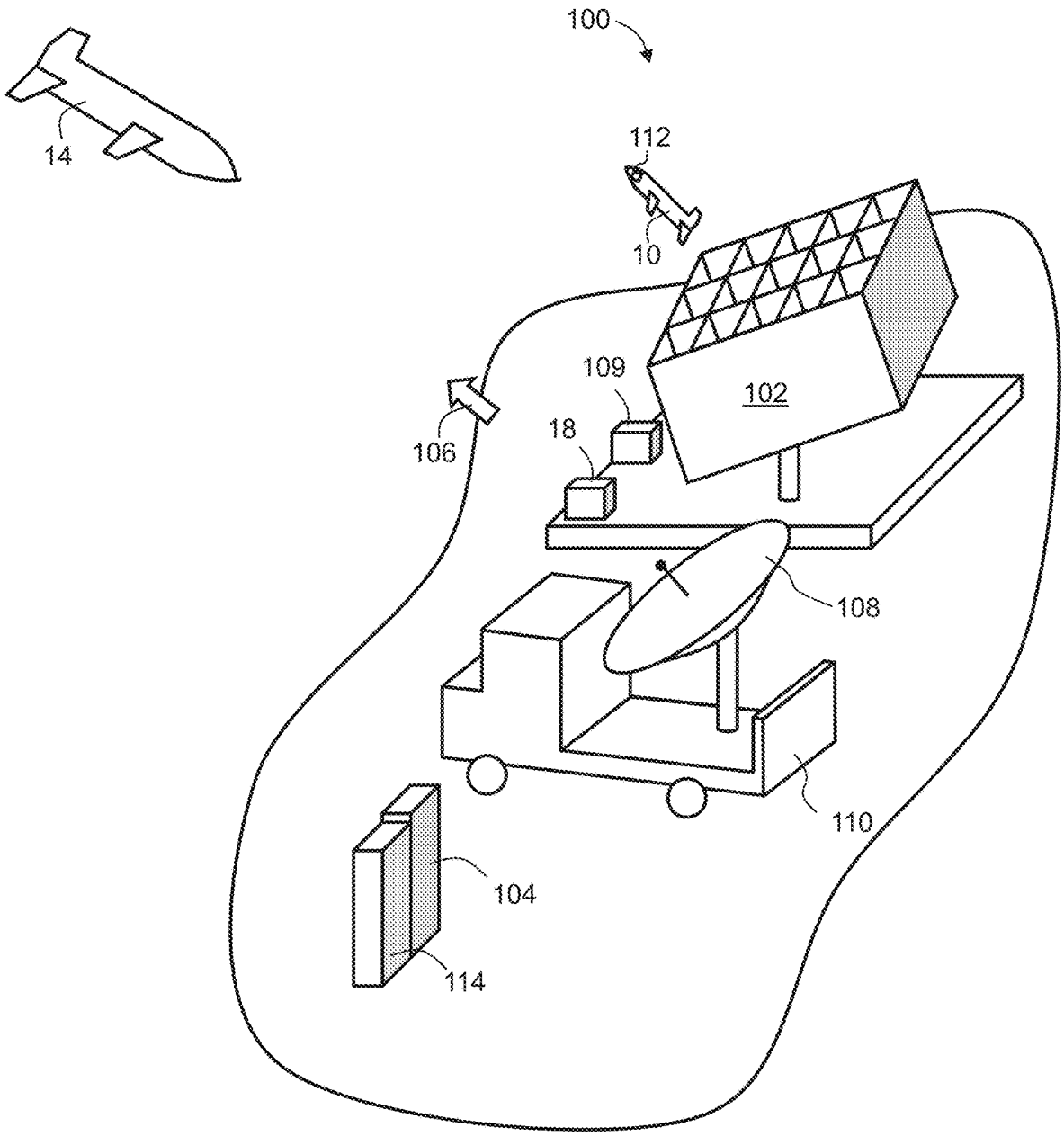
FIG. 10 is a schematic illustration a system for guiding the guidable guided vehicle to the target, according to some embodiments of the present invention.

Reference is now made to FIG. 10 which is a schematic illustration of a system 100 for guiding guided vehicle 10 to target 14, according to some embodiments of the present invention.

FIG. 10 illustrates an embodiment in which guided vehicle 10 is a missile launched from a missile launcher 102 to intercept target 14 which is also a missile, but this need not necessarily be the case, as guided vehicle 10 can be of any of the aforementioned types.

System 100 optionally and preferably comprises a illuminator 18 for illuminating target 14, Illuminator 18 can in some embodiments of the present invention also illuminate guided vehicle 10. The illuminator 18 can be mounted on a static or moving platform. In the illustrated embodiment, illuminator 18 is positioned in a ground station, but embodiments in which illuminator 18 is carried by another guided vehicle, such as an aircraft or a ship, are also contemplated. Illuminator 18 illuminates target 14 by directing electromagnetic radiation 106 to target 14. The electromagnetic radiation 106 is optionally in the form of a Radar or a laser beam in the visible or ultraviolet or infrared range, light or sound wave. System 100 optionally and preferably comprises a designator 109 for providing reference coordinates for the homing law and is one of the 3 points (virtual designator, guided vehicle, and target) alignment law.

System 100 typically also comprises an acquisition system 108 e.g., a tracking system, for acquiring a position vector of target 14 and optionally also a position vector of guided vehicle N. In the representative illustration shown in FIG. 10, which is not to be considered as limiting, acquisition system 108 is shown as a radar mounted on a platform 110, illustrated as a carrier truck. Other types of acquisition systems are also contemplated. Acquisition system 108 and illuminator 18 need not be to separate systems. In some embodiments, the acquisition of the position vector(s) by illuminating the target 14 and/or guided vehicle 10, receiving echoes from them and calculating direction and/or ranges to them. In these embodiments it is not necessary for system 100 to include a separate acquisition system. Further, in some embodiments, the position vector of target 14 is acquired by a tracking system 112 carried by guided vehicle 10, in which case acquisition system 108 can be enacted by tracking system 112. In this embodiment, the position vector of target 14 is acquired by tracking system 112 and the position vector of guided vehicle 10 can be acquired by a separate acquisition system, such as, but not limited to, an on-board Inertial Navigation System (INS).

System 100 also comprises a guidance processor 104 configured to receive the acquired position vectors and execute the calculations described herein, and a guidance controller 114 configured to control the guided vehicle 10 as described herein. Typically, guidance processor 104 receives the position vectors via a data link (not shown) to acquisition system 108, illuminator 18 and/or guided vehicle 10, and guidance controller 114 control the guided vehicle 10 as by transmitting to guided vehicle 10 maneuvering commands over a data link (not shown) established between guidance controller 114 and guided vehicle 10. Guidance processor 104 and guidance controller 114 can be separate units or they can be integrated in a single guidance processing and control system. The present embodiments also contemplate configurations guided vehicle in which the position vector of target 14 is acquired by system 112, and guidance processor 104 and guidance controller 114 are carried by guided vehicle 10.

As used herein the term "about" refers to ±10% at least.

The word "exemplary" is used herein to mean "serving as an example, instance or illustration." Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments." Any particular embodiment of the invention may include a plurality of "optional" features unless such features conflict.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Various embodiments and aspects of the present invention as delineated hereinabove and as claimed in the claims section below find experimental support in the following examples.

EXAMPLES

Reference is now made to the following examples, which together with the above descriptions illustrate some embodiments of the invention in a non limiting fashion.

Computer Simulations

Computer simulations were performed to study the ability of the technique of the present embodiments to achieve successful homing.

Figure 11A:
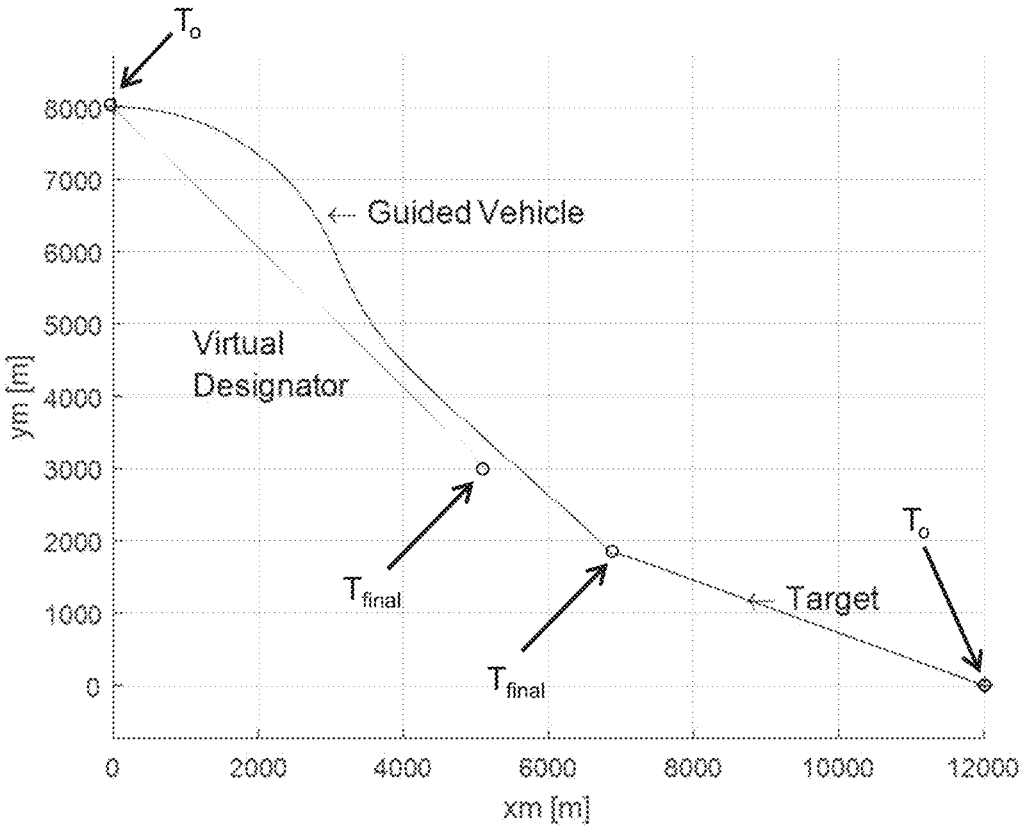
FIGS. 11A and 11B show trajectories obtained according to some embodiments of the present invention using simulated data.
Figure 11B:
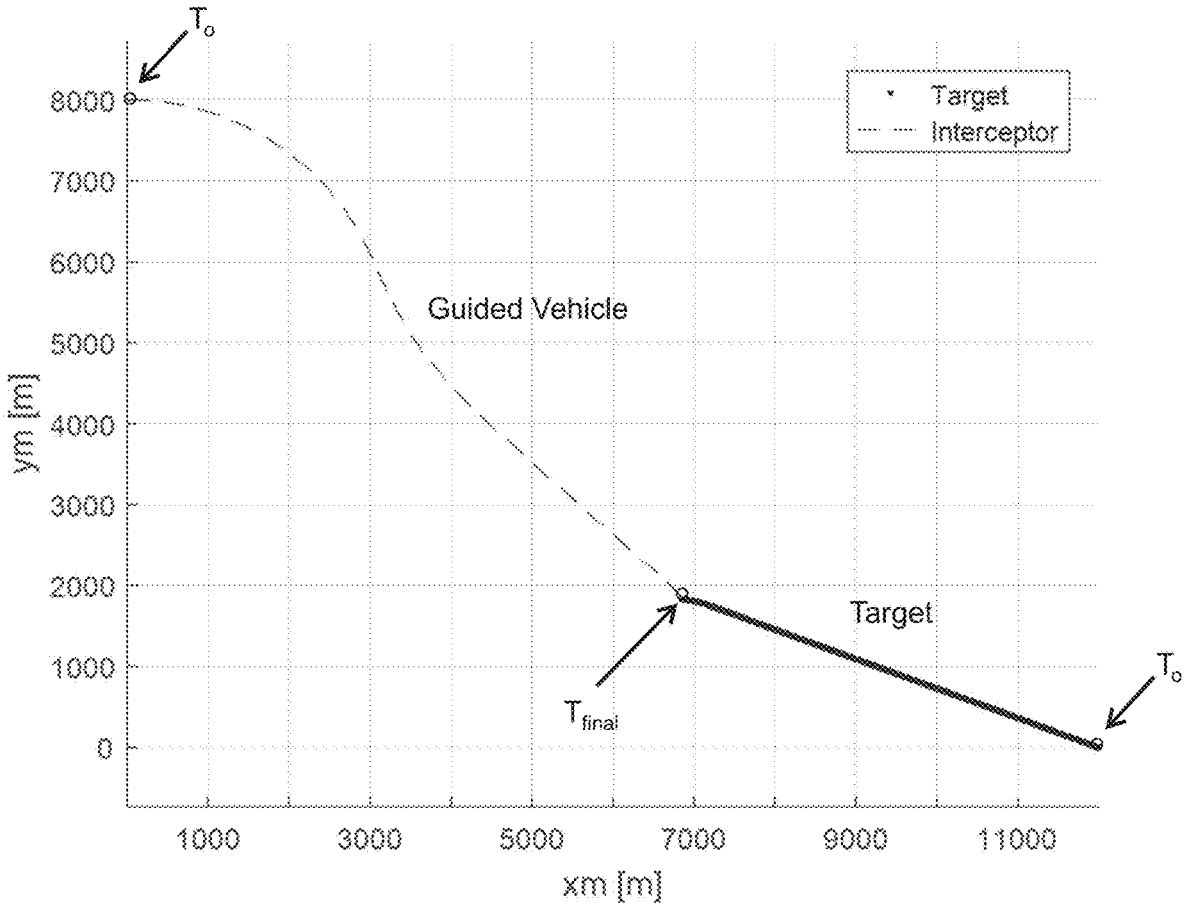

FIGS. 11A and 11B show trajectories Obtained using simulated data by executing the homing loop of the present embodiments (FIG. 11A) and by executing conventional PN homing loop FIG. 11B).

Figure 12A:
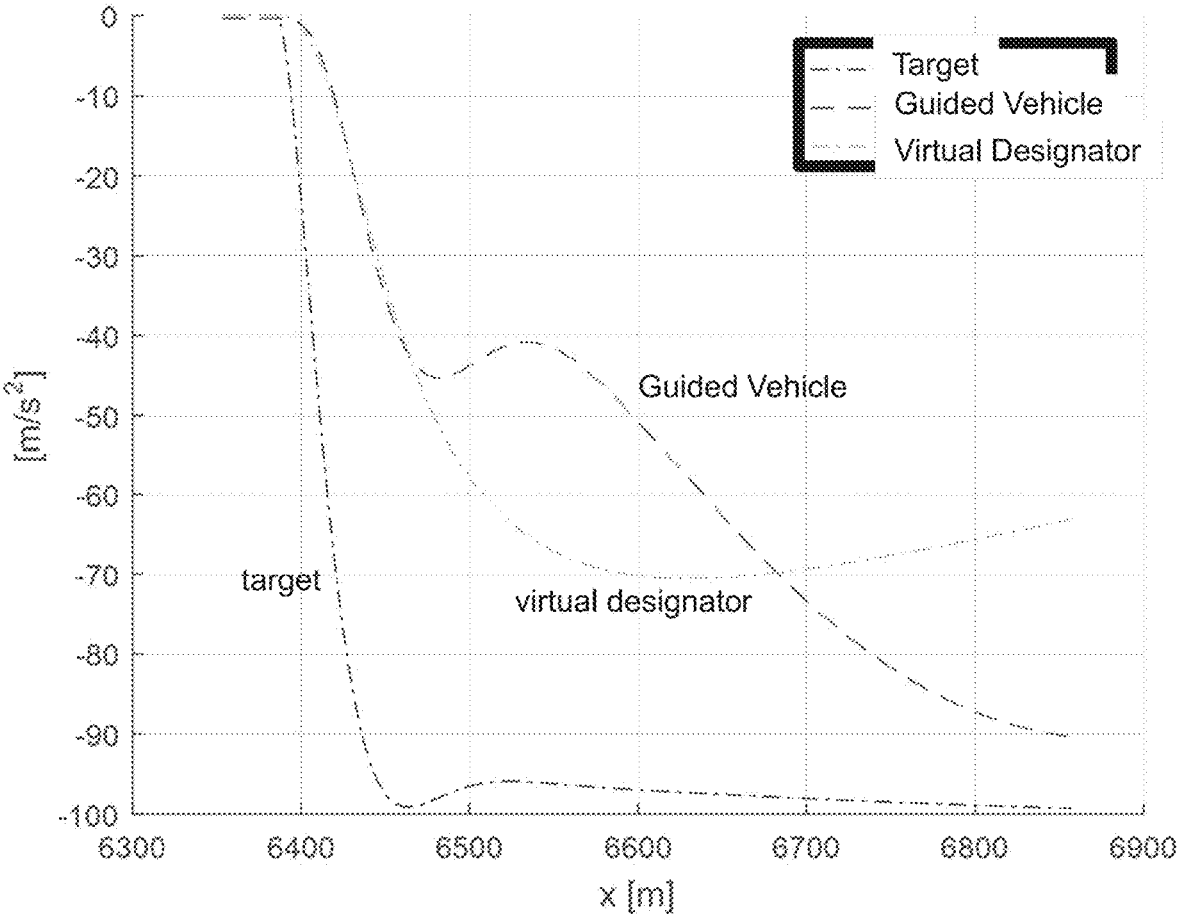
FIGS. 12A and 12B are graphs showing transverse accelerations (normal to the respective velocity vectors) obtained according to some embodiments of the present invention.
Figure 12B:
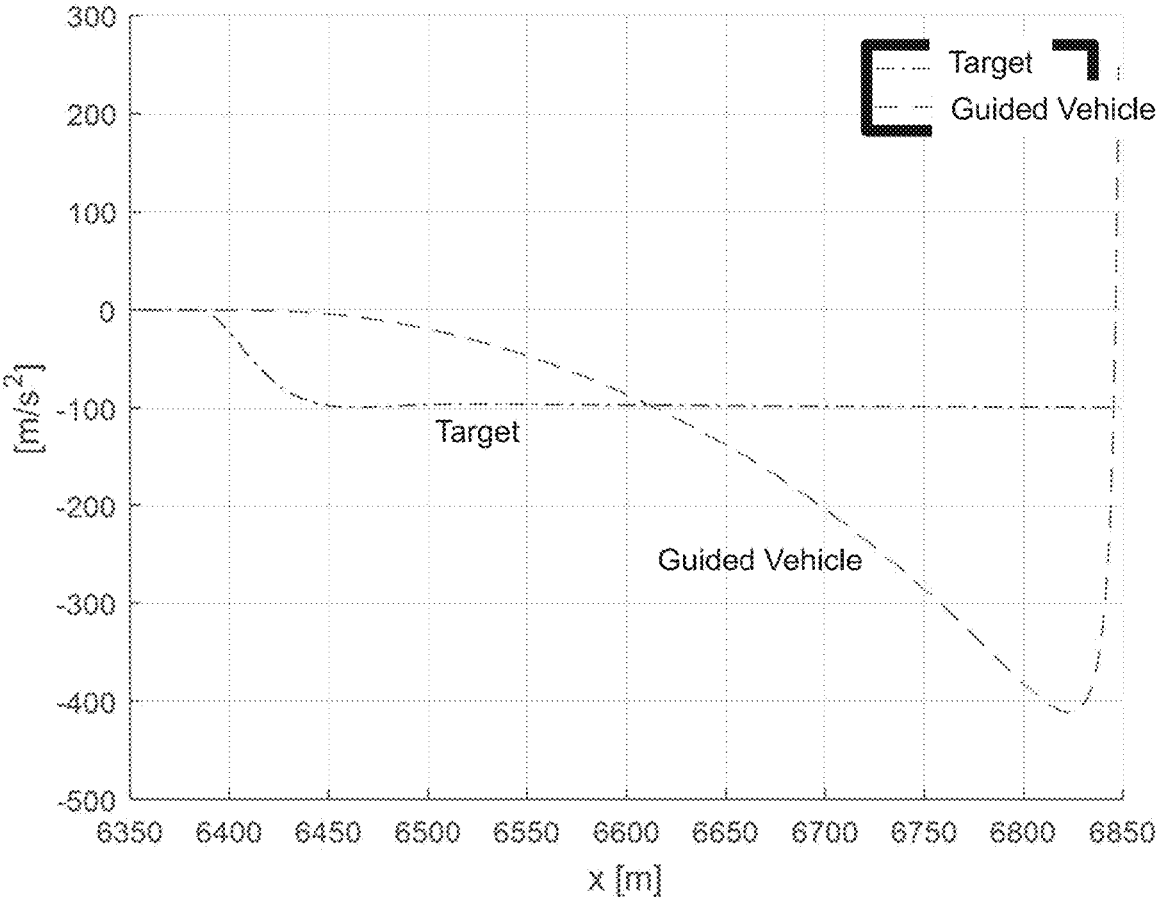
Figure 13A:
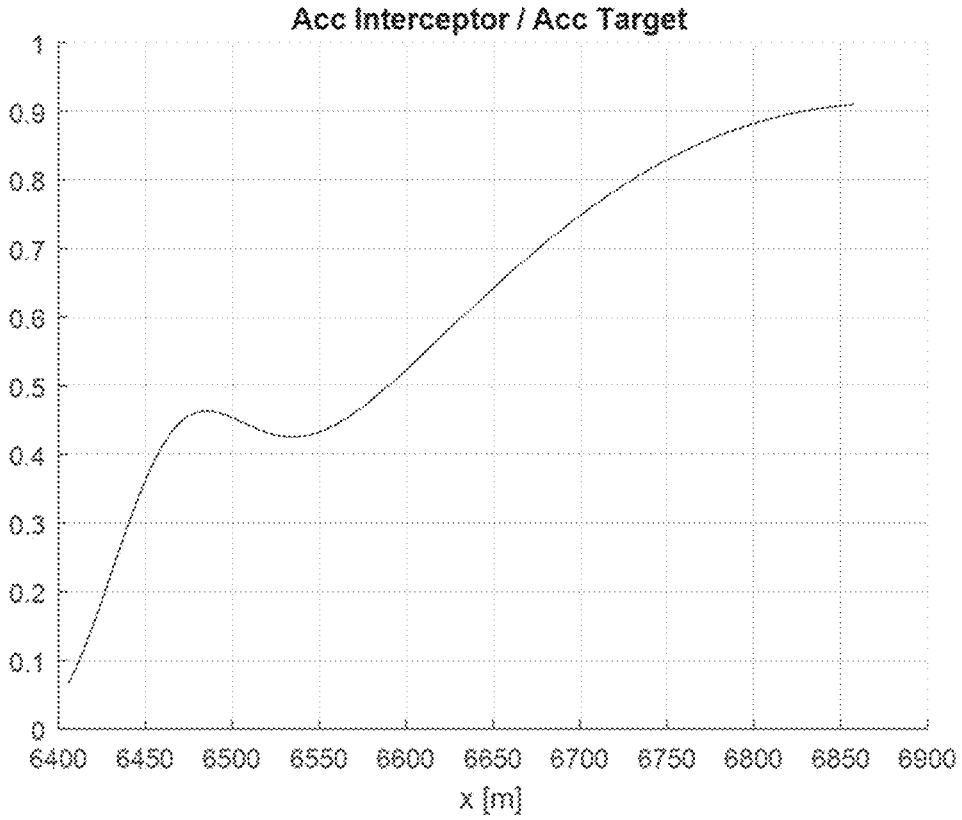
FIGS. 13A and 13B show ratios between the transverse accelerations shown in FIGS. 12A and 12B, respectively.
Figure 13B:
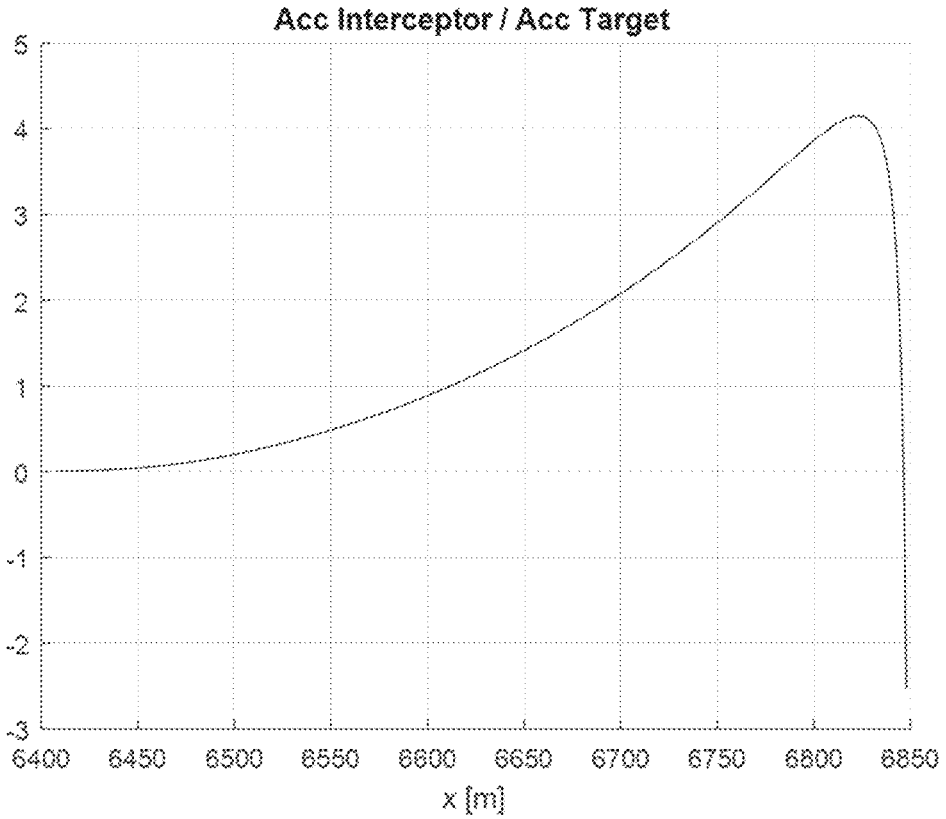

FIGS. 12A and 12B show final transverse accelerations (normal to the respective velocity) obtained using simulated data by executing the homing loop of the present embodiments (FIG. 12A) and by executing conventional PN homing loop (FIG. 12B). FIGS. 13A and 13B show the ratio between the transverse acceleration of the guided vehicle and the transverse acceleration of the target shown in FIGS. 12A and 12B, respectively.

As shown in FIGS. 11A-13B, while for both the guided vehicle and the target the homing loop of the present embodiments archives similar trajectories as PN (FIGS. 11A-B), the required transverse acceleration of the guided vehicle for achieving successful homing are significantly smaller for the horning loop of the present embodiments (FIG. 12A) than for the conventional PN homing loop (FIG. 12B). In particular, while in the conventional PN homing loop the guided vehicle's transverse acceleration needs to significantly exceed the target's transverse acceleration (FIGS. 12B and 13B), the transverse acceleration provided by the homing loop of the present embodiments does not exceed the target's transverse acceleration throughout the loop. The trajectory followed by the virtual designator of the present embodiments was a straight line (FIG. 11A, dot-dashed line). Its transverse acceleration is shown by the dot-dashed line of the FIG. 12A.

GPS Guidance

Military GPS precision, for position and speed estimations, insure a good hit precision for GPS guided platforms. Civil GPS position precision (e.g., 10 m for horizontal x-y plane and 20 m for height h) implies a ground collision dispersion ΔR according to:

$$\Delta R^2=\Delta x^2+\Delta y2+(\Delta h/\tan(\Upsilon_{final}))^2$$

where $\Upsilon_{final}$ is the collision angle related to horizontal plane. The hit error due to vertical error sources increases from zero for a vertical hit trajectory to unlimited for an horizontal trajectory, as exemplified in the following table, for the case of Δh=20 m:

| $\Upsilon_{final}$ [deg] | 0 | 15 | 39 | 45 | 60 | 75 | 90 |
|---|---|---|---|---|---|---|---|
| $20/\tan(\Upsilon_{final})$ [m] | ∞ | 79 | 34.6 | 20 | 11.5 | 5 | 0 |

Small $\Upsilon_{final}$ at collision angles, and consequently high collision dispersion, are typical for long range guidance and some scenarios in which the initial velocity vector of the guided vehicle has upwardly directed vertical component (e.g., the so call "loft bombing").

Figure 14A:
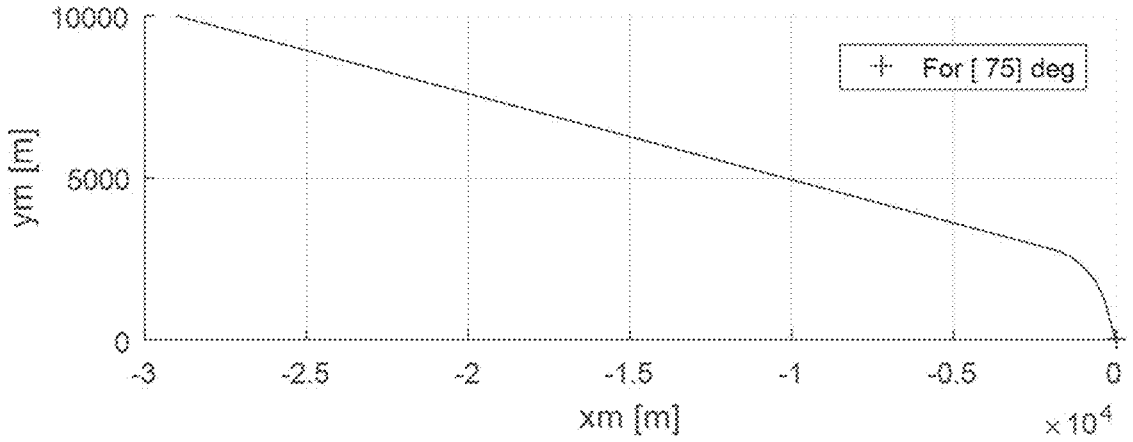
FIGS. 14A and 14B show exemplified trajectories for GPS-based homing, as obtained according to some embodiments of the present invention using simulated data.
Figure 14B:
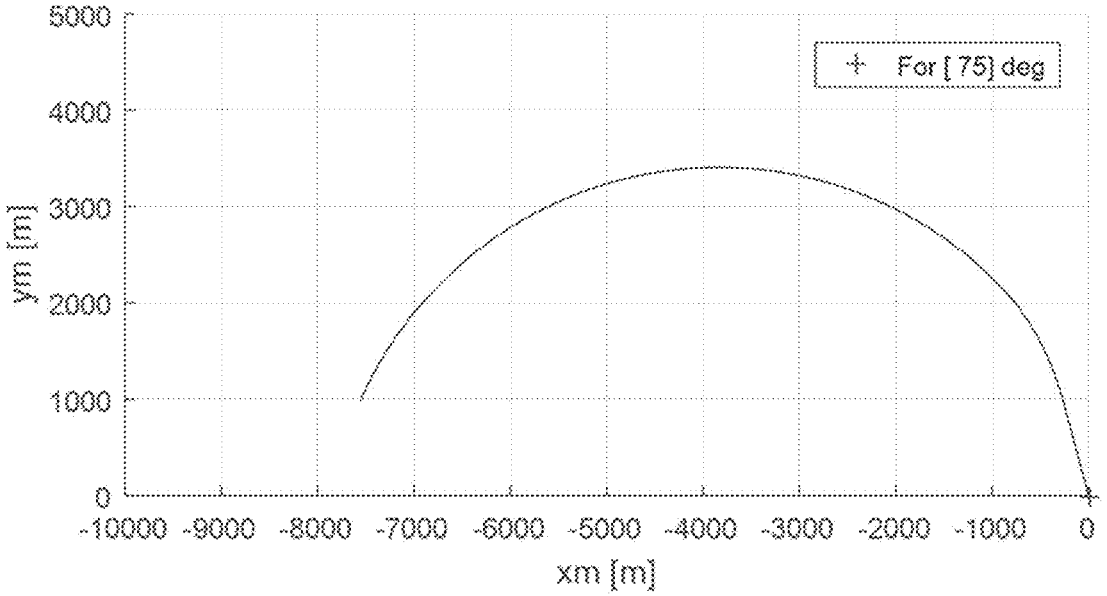
Figure 15:
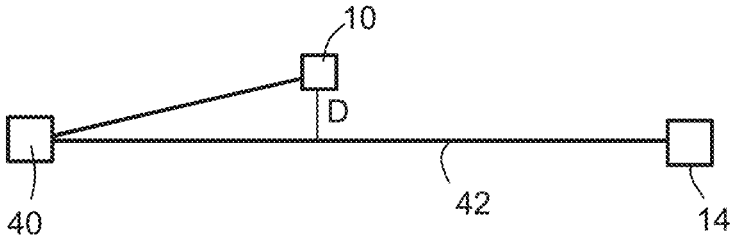
FIG. 15 is a schematic illustration of a guided vehicle, a target, a virtual designator, and a virtual line, according to some embodiments of the present invention.

The homing of the present embodiments allows a short horning range to reach a high hit angle and consequently a better hit precision, even with civil GPS precision, as demonstrated in FIG. 14A (for long range guidance), and FIG. 14B (for loft bombing).

As shown in FIG. 14A, a small vertical angle flight path for midcourse insures a long range trajectory. A 1 g turn over to high diving angle (near $75^0$) close to the target insures appropriate initial condition for homing according to some embodiments of the present invention. High vertical collision angle decreases the contribution of GPS measurement vertical bias.

FIG. 14B shows ballistic trajectory from aircraft release point. Identical Ig turn over and homing according to some embodiments of the present invention achieves high vertical collision angle and improved collision precision.

FIGS. 14A and 14B demonstrate that the higher collision angle allows improved collision precision at the cost of a relatively small decrease of the maximum range between the guided vehicle and the target.

Performance Comparison

Following is a summary of the performances of the homing loop of the present embodiments in comparison to conventional PN and CLOS, demonstrating the ability of the technique of the present embodiments to enjoy the advantages of both PN and CLOS, and to outperform them.

| Guided vehicle | PN | CLOS | Present Embodiments |
|---|---|---|---|
| Transverse acceleration due to target velocity$\perp_{LOS}$ | 0 | High | 0 |
| Transverse acceleration due to target acceleration$\perp_{LOS}$ | $3a_T$ | $\leq a_T$ | $\leq a_T$ |
| Transverse acceleration due to LOS rotation | 0 | large | 0 |
| time response relative to the homing time constant τ | 10τ | 3τ | 3τ |
| Range limitation | No | Launcher target in tracking range | No |

-continued

| Guided vehicle | PN | CLOS | Present Embodiments |
|---|---|---|---|
| Measurement errors | Decrease with decreasing guided vehicle-target range Sensitive to $\dot{\lambda}$ | Increase with increasing designator-guided vehicle range When target tracking is by the guided vehicle, decrease with decreasing guided vehicle-target range | Increase with increasing tracker-guided vehicle or tracker-target range When target tracking is by the guided vehicle, decrease with decreasing guided vehicle-target range |
| Required measurements | Rotation rate of guided vehicle-target LOS Ranges Ranges rates measurements or estimations | Angular differences: designator-guided vehicle, and designator-target Ranges | Target's position vector Angular difference: designator-guided vehicle, and designator-target Guided vehicle's position vector Optional Rate of changes in position vector(s) |
| ZEM extension | Yes | No | Yes |
| Chosen Hit Direction | Approximate | No | Easy |
| Deviated Hit Point Predetermined Miss Distance | Possible | No | Easy |

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any mference in this application shall not be construed as an admission that such reference is available as prior art to the present invention. To the extent that section headings are used, they should not be construed as necessarily limiting.

In addition, any priority document(s) of this application is/are hereby incorporated herein by reference in its/their entirety.

What is claimed is:

1. A system for guiding a guidable vehicle to a target, the system comprising:

a tracking system for acquiring at least one position vector describing a position of the target and a position of the guidable vehicle;

a guidance processor configured to define a virtual designator at a point in space, and to calculate a distance between the guidable vehicle and a virtual line passing through the target and also through said virtual designator; and a guidance controller configured to control the guidable vehicle to reduce said calculated distance;

wherein said guidance processor is also configured to automatically shift said virtual line parallel to itself responsively to repeated acquisitions of said at least one position vector by tracking system.

2. The system according to claim 1, wherein said guidance processor is configured for moving said virtual designator along a collision trajectory between said virtual designator and the target.

3. The system according to claim 1, further comprising calculating a Zero Effort Miss (ZEM), wherein said calculation of said distance is based on said ZEM.

4. The system according to claim 1, wherein the target is stationary.

5. The system according to claim 1, wherein the target is moving at a velocity having a magnitude which is less than half the magnitude of a maximal velocity of the guidable vehicle.

6. The system according to claim 1, wherein said guidance processor is configured for receiving a priori coordinates of said target and acquiring a position vector of the target based on said coordinates.

7. The system according to claim 1, further comprising an illuminator configured to illuminate the target by radiation, wherein said acquisition of said at least one position vector, is based on an echo or reflection of said radiation from the target.

8. The system according to claim 1, wherein said tracking system is a passive tracking system.

9. The system according to claim 1, wherein said tracking system comprises a Global Positioning System, and is configured for acquiring a position vector of the target based, at least in part, on data obtained by said Global Positioning System.

10. The system according to claim 1, wherein said tracking system comprises a Global Positioning System, and is configured for acquiring a position vector of the guidable vehicle based on data obtained by said Global Positioning System.

11. The system according to claim 1, wherein said guidance processor is configured for receiving an input direction of impact between the guidable vehicle and the target, and for defining said virtual line based on said input direction of impact.

12. The system according to claim 1, wherein said guidance processor is configured for biasing said distance between the guidable vehicle and said line, and wherein said guidance controller is configured for controlling the guidable vehicle to reduce said biased distance.

13. The system according to claim 1, wherein a position vector of the target is relative to the guidable vehicle.

14. The system according to claim 1, wherein said tracking system is carried by the guidable vehicle.

15. The system according to claim 1, wherein said tracking system is carried by another vehicle.

16. The system according to claim 1, wherein said tracking system is stationary.

17. The system according to claim 1, wherein the guidable vehicle is selected from the group consisting of an aerial vehicle, a ground vehicle, an aqueous vehicle, a subaqueous vehicle, an amphibious vehicle, a semi-amphibious vehicle, and a spacecraft.

18. A system for guiding a guidable vehicle to a target, the system comprising:

a tracking system for acquiring at least one position vector describing a position of the target and a position of the guidable vehicle;

a guidance processor configured to define a virtual designator at a point in space, and to calculate a distance between the guidable vehicle and a virtual line passing through a predicted position of the target and also through said virtual designator; and a guidance controller configured to control the guidable vehicle to reduce said calculated distance;

wherein said guidance processor is also configured to automatically update said virtual line responsively to repeated acquisitions of said at least one position vector by tracking system.

19. A system for guiding a guidable vehicle to a target, the system comprising:

a tracking system for acquiring at least one position vector describing a position of the target and a position of the guidable vehicle;

a guidance processor configured to receive an input direction of impact between the guidable vehicle and the target, to define a virtual line passing through the target based on said input direction of impact, and to calculate a distance between the guidable vehicle and said virtual line; and a guidance controller configured to control the guidable vehicle to reduce said calculated distance;

wherein said guidance processor is also configured to automatically shift said virtual line parallel to itself responsively to repeated acquisitions of said at least one position vector by tracking system.

20. A system for guiding a guidable vehicle to a target, the system comprising:

a tracking system for acquiring at least one position vector describing a position of the target and a position of the guidable vehicle;

a guidance processor configured to calculate a distance between the guidable vehicle and a virtual line passing through the target; and a guidance controller configured to control the guidable vehicle to reduce said calculated distance;

wherein said guidance processor is also configured to automatically shift said virtual line parallel to itself responsively to repeated acquisitions of said at least one position vector by tracking system;

wherein said guidance processor is configured for biasing said distance between the guidable vehicle and said line; and wherein said guidance controller is configured for controlling the guidable vehicle to reduce said biased distance.

* * * * *